US011519690B2

(12) United States Patent
Aldstadt

(10) Patent No.: US 11,519,690 B2
(45) Date of Patent: Dec. 6, 2022

(54) SEMI-AUTOMATIC RIFLE

(71) Applicant: Stephen Aldstadt, La Salle (CA)

(72) Inventor: Stephen Aldstadt, La Salle (CA)

( * ) Notice: Subject to any disclaimer, the term of this patent is extended or adjusted under 35 U.S.C. 154(b) by 0 days.

(21) Appl. No.: 17/094,107

(22) Filed: Nov. 10, 2020

(65) Prior Publication Data

US 2022/0282950 A1 Sep. 8, 2022

Related U.S. Application Data

(60) Provisional application No. 62/935,712, filed on Nov. 15, 2019.

(51) Int. Cl.

| | |
|---|---|
| ***F41A 3/66*** | (2006.01) |
| ***F41C 23/16*** | (2006.01) |
| *F41A 21/48* | (2006.01) |
| *F41A 5/26* | (2006.01) |
| *F41A 3/26* | (2006.01) |

(52) U.S. Cl.

CPC ..... *F41C 23/16* (2013.01); *F41A 3/66* (2013.01); *F41A 3/26* (2013.01); *F41A 5/26* (2013.01); *F41A 21/48* (2013.01)

(58) Field of Classification Search

CPC ..... F41A 3/66; F41C 23/16

See application file for complete search history.

(56) References Cited

U.S. PATENT DOCUMENTS

| | | | | |
|---|---|---|---|---|
| 8,590,201 | B2 * | 11/2013 | Brixius | F41C 23/16 42/71.01 |
| 10,739,107 | B2 * | 8/2020 | Drake | F41C 27/00 |
| 11,015,884 | B2 * | 5/2021 | Drake | F41A 3/66 |
| 2009/0211140 | A1 * | 8/2009 | Rolfe | F41C 23/04 42/71.01 |
| 2021/0325138 | A1 * | 10/2021 | Seekins | F41A 35/02 |

* cited by examiner

*Primary Examiner* — Reginald S Tillman, Jr.

(74) *Attorney, Agent, or Firm* — Bennet K. Langlotz; Langlotz Patent & Trademark Works, LLC

(57) ABSTRACT

A self-loading rifle comprising: an upper receiver defining a bolt passage, a bolt operable to reciprocate in the passage motivated by energy from discharge of the rifle, and a barrel extending from the upper receiver. The lower receiver is connected to the upper receiver and contains a trigger group and has a forwardly-extending support below the barrel, a tubular handguard encompassing at least a rear portion of the barrel, and is connected to the forwardly-extending support. The self-loading rifle of claim 1 in this the handguard is not directly connected to the upper receiver or to the barrel.

2 Claims, 40 Drawing Sheets

SEMI-AUTOMATIC RIFLE

CROSS-REFERENCE TO RELATED APPLICATIONS

This application claims the benefit of U.S. Provisional Patent Application No. 62/935,712, filed on Nov. 15, 2019, entitled "PGWDTI Direwolf Semi-Automatic Rifle", which is hereby incorporated by reference in its entirety for all that is taught and disclosed therein.

FIELD OF THE INVENTION

The present invention relates to semi-automatic rifles.

BACKGROUND AND SUMMARY

Semi-automatic rifles may suffer from accuracy limitations compared to bolt action rifles due to the different moving parts and the means of attaching them together. A typical semi-auto rifle has a handguard surrounding the barrel and used to support a forward portion of the rifle. This may be connected directly to the upper receiver from which the barrel extends to avoid contacting a forward portion of the barrel. The configuration is called "free floating." However, the handguard still contacts the upper receiver with the mounted barrel, and this and other factors in the convention design can disrupt accuracy.

The preferred embodiment addresses these concerns by providing a self-loading rifle comprising: an upper receiver defining a bolt passage, a bolt operable to reciprocate in the passage motivated by energy from discharge of the rifle, and a barrel extending from the upper receiver. The lower receiver is connected to the upper receiver and contains a trigger group and has a forwardly-extending support below the barrel, a tubular handguard encompassing at least a rear portion of the barrel, and is connected to the forwardly-extending support. The self-loading rifle of claim 1 in this the handguard is not directly connected to the upper receiver or to the barrel.

DETAILED DESCRIPTION OF A PREFERRED EMBODIMENT

Figure 1:
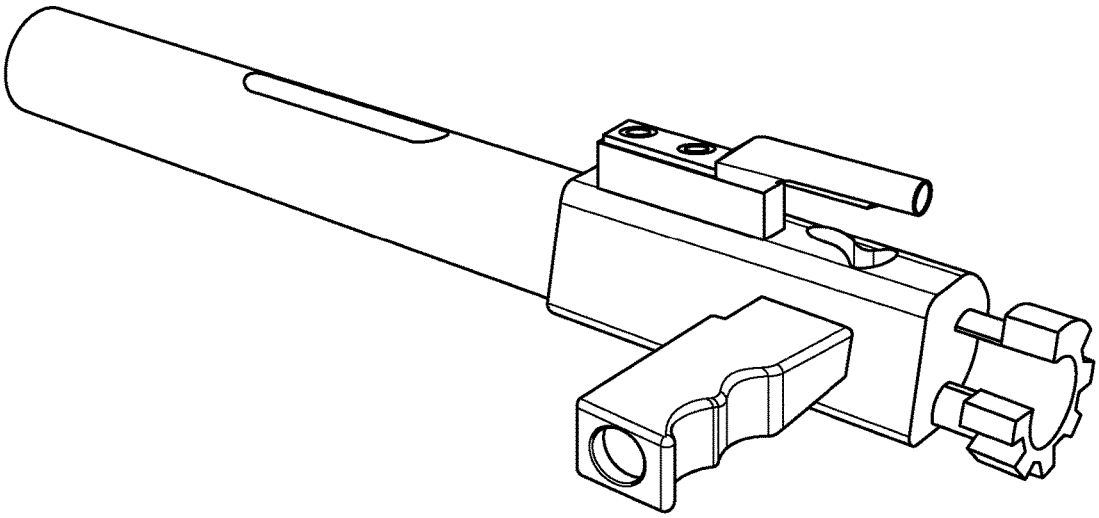
FIGS. 1-16 show the process of the semi-automatic rifle being used.

FIG. 1 shows the bolt carrier group.

Figure 1A:
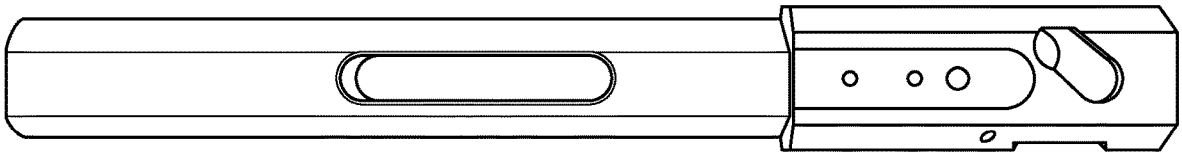

FIG. 1A shows a top view of the bolt carrier body. There is a view of the slot for the cam pin which allows the bolt when installed to rotate and lock into position then unlock and cam out. There is a relief cut for the gas key with a gas hole and two threaded mounting holes. The tail end of the carrier is the section that slides into the buffer tube and has a slot cut out to give the hammer access to the firing pin.

Figure 1B:
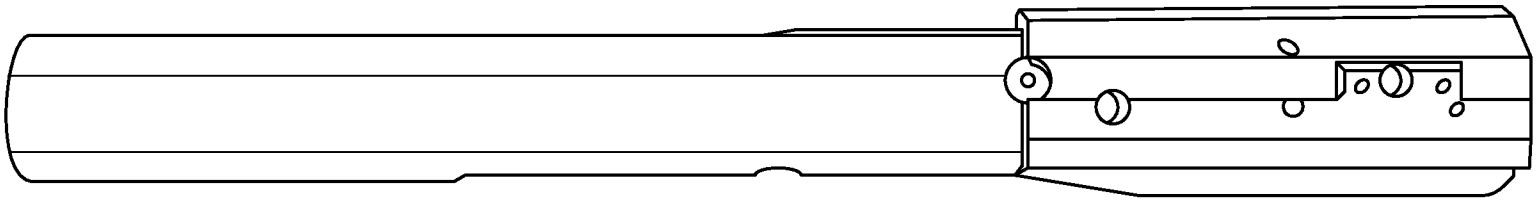

FIG. 1B shows a side profile of the bolt carrier body. There is a relief cut out for the bolt handle which is held in place by 2 pins and a threaded hole in the center. The bolt handle is fixed and reciprocates with the bolt carrier group.

The two vertically aligned holes are for forward gas venting when the bolt is in the open position, the rear single hole is for excess gas venting when the bolt is in the closed position.

Figure 1C:
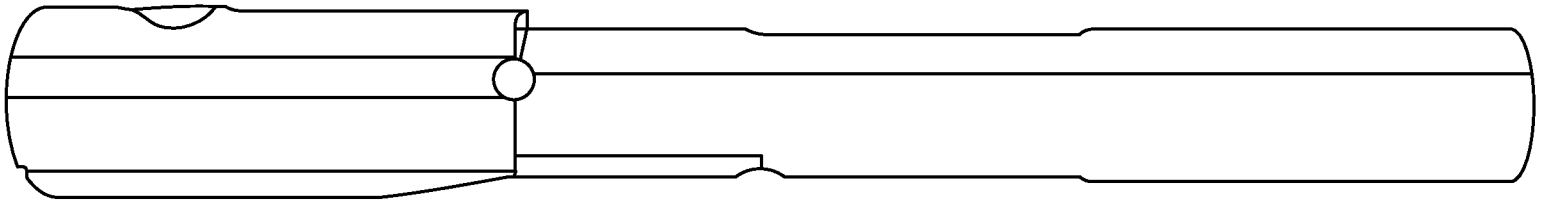

FIG. 1C shows the opposite side profile of 1B detailing the hole for the retaining pin for the firing pin. It allows the firing pin to move bidirectional within the bolt carrier and restricts the amount of movement forwards and back.

Figure 1D:
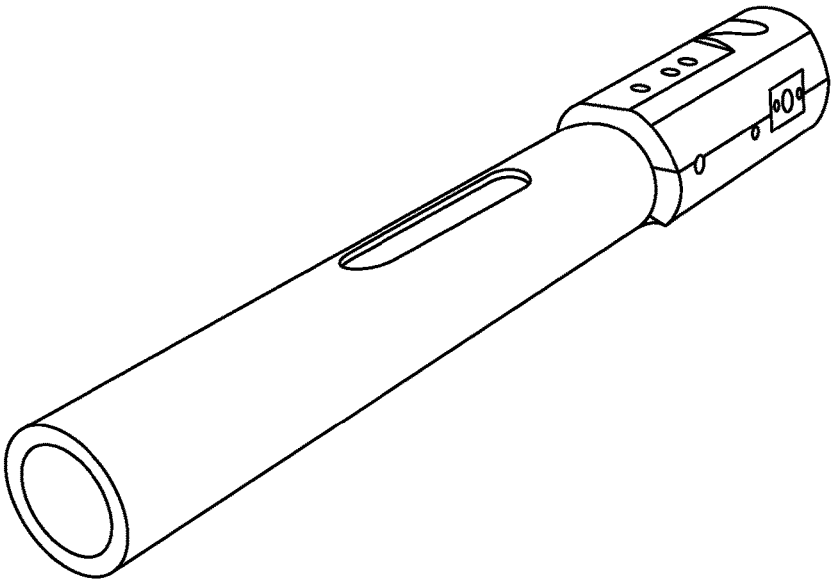

FIG. 1D is a view of the bolt carrier body.

Figure 1E:
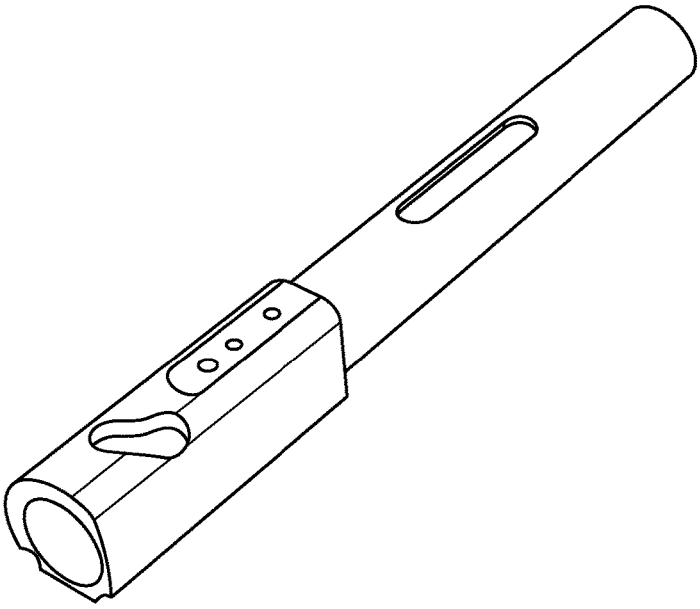

FIG. 1E is a view of the bolt carrier body.

Figure 1F:
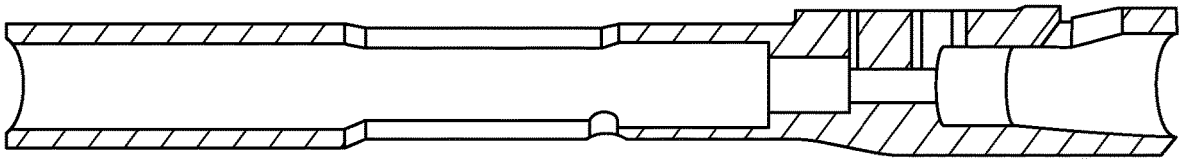

FIG. 1F shows a cut away of the internal view of the bolt carrier body. Here you can see all of the journals that the bolt seats in and moves along and where the firing pin is held by its retaining pin.

Figure 1G:
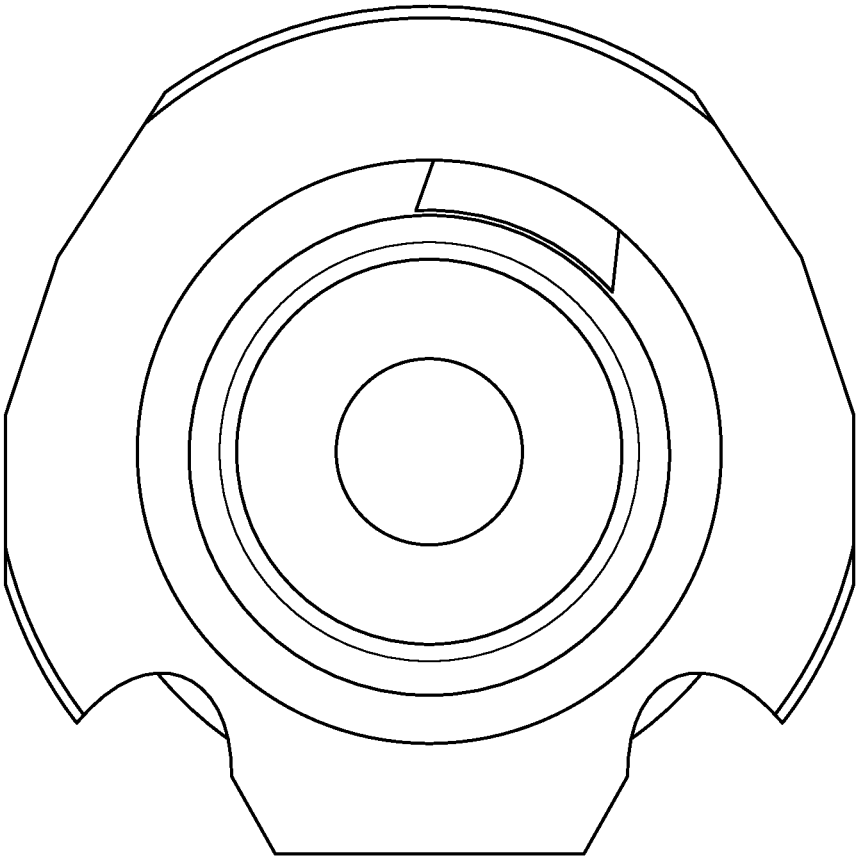

FIG. 1G shows a front facing view of where the bolt inserts into the carrier and is locked in place by the cam pin, allowing it to reciprocate and rotate in and out of the carrier body.

Figure 2A:
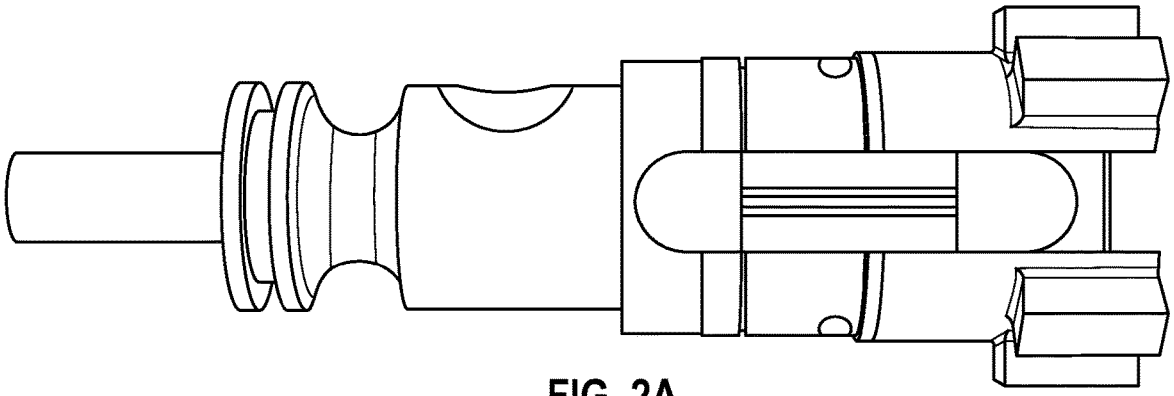

FIG. 2A shows a top view of the bolt. There is a slot cut out for the extractor and is held in by a cross hole with a pin. The large hole in the bolt body is where the cam pin goes through to orient the bolt into the open and closed positions. The radial groove on the tail section is to capture gas to push against the gas rings which are seated in the smaller groove.

Figure 2B:
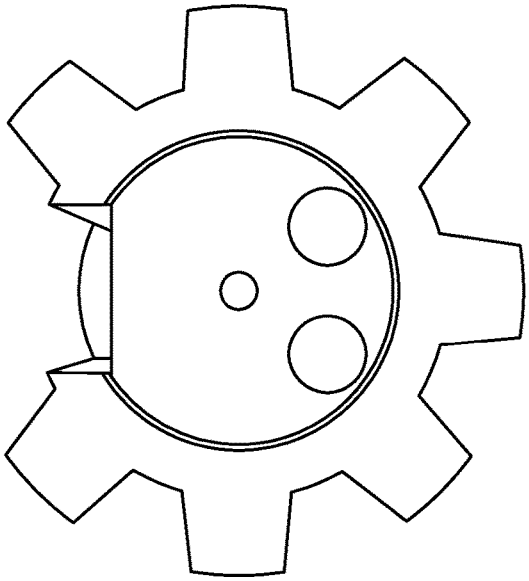

FIG. 2B shows the bolt face with 7 lugs. The two vertical holes are for the dual ejectors and a hole in the center for the firing pin.

Figure 2C:
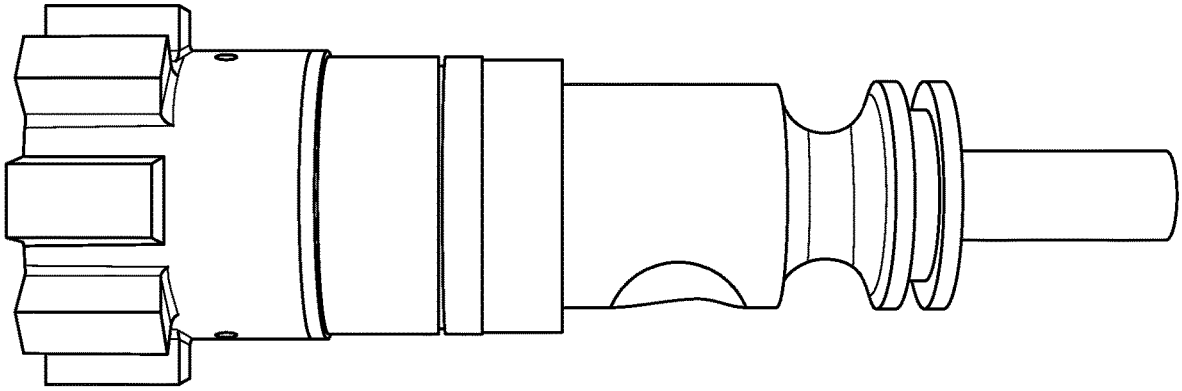

FIG. 2C is a view of the bolt.

Figure 2D:
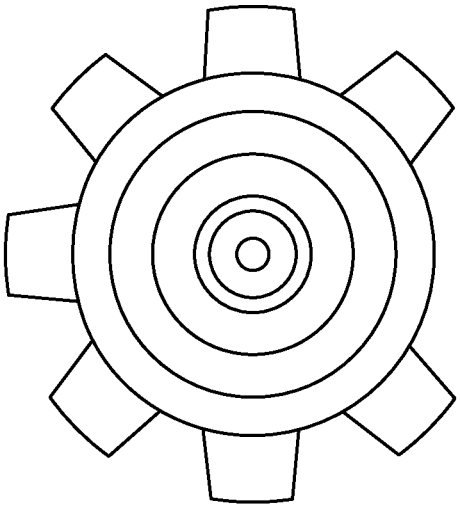

FIG. 2D is a view of the bolt.

Figure 2E:
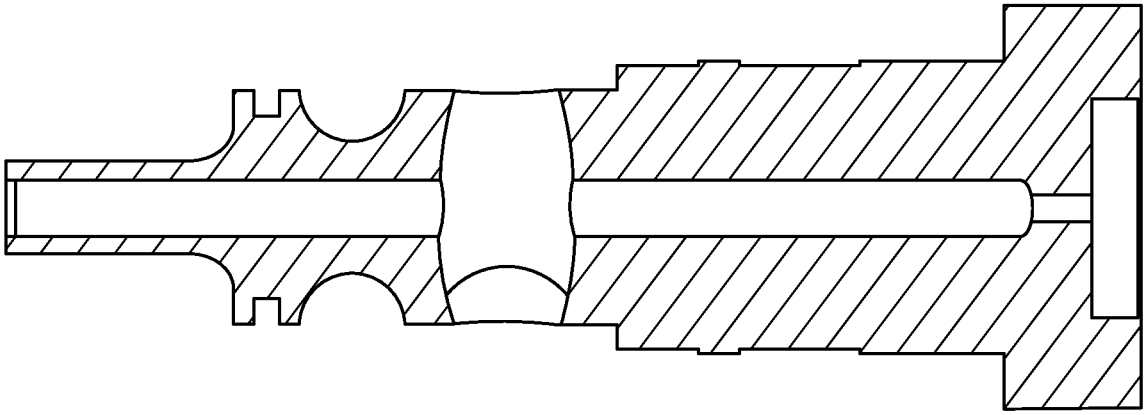
Figure 2F:
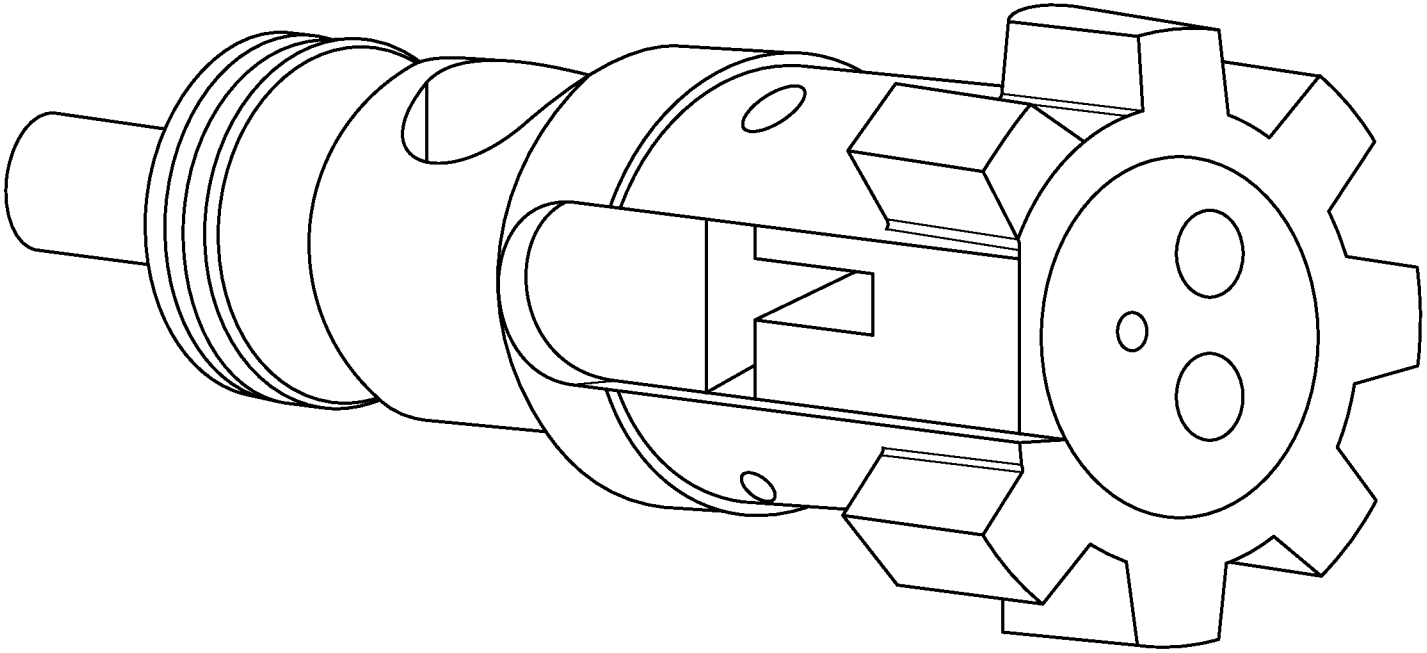

FIG. 2E shows an internal view of the bolt. The deep hole running through the part is to house the firing pin body.

Figure 3A:
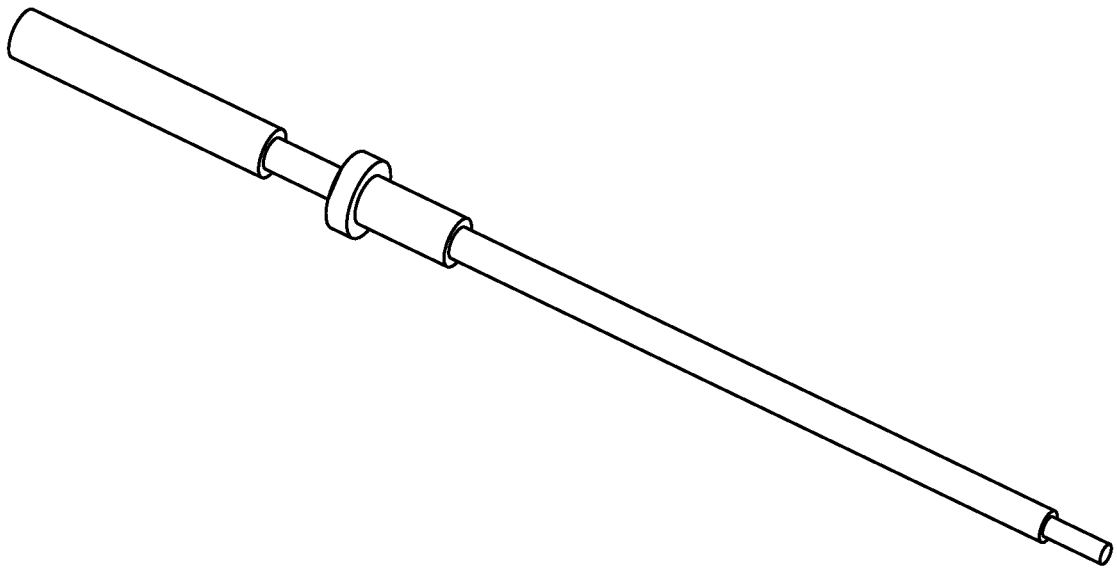

FIG. 3A shows the firing pin. The smallest diameter is the firing pin tip which protrudes through the bolt and penetrates the primer when the trigger is pulled. The shaft the pin tip is connected to runs inside the bolt body to keep it straight and concentric. The shoulder that follows the long section is what prevents the firing pin from protruding too far and piercing the primer. Beyond that shoulder is a small section between 2 shoulders, this is where the pin goes through the bolt carrier to keep the firing pin in place and prevents the firing pin from having too much forwards and backwards travel.

Figure 3B:
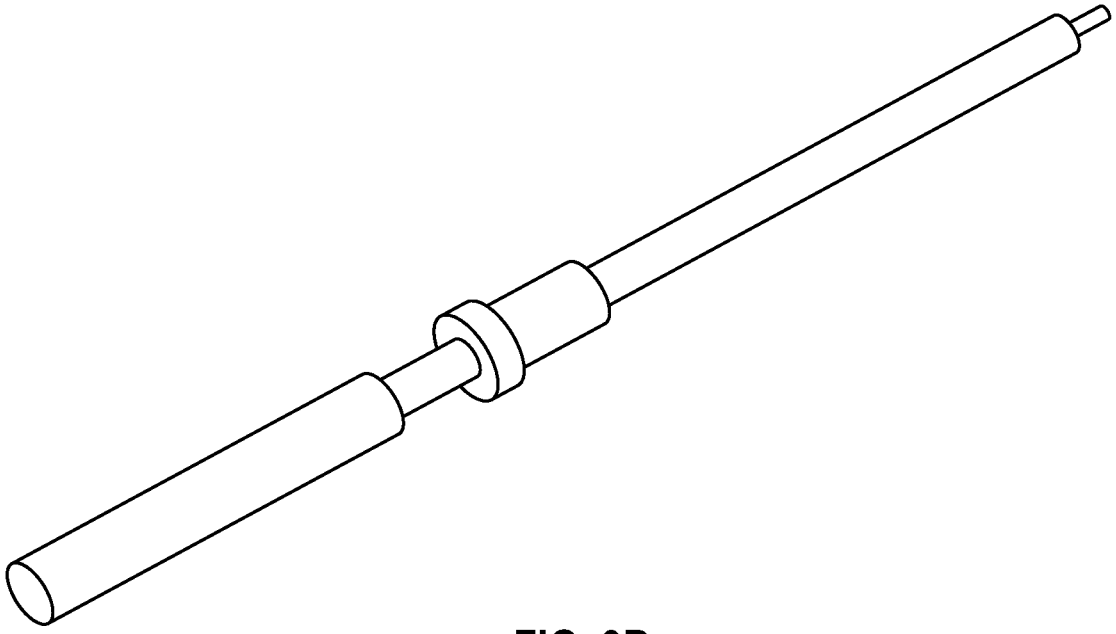

FIG. 3B is a view of the firing pin.

Figure 4A:
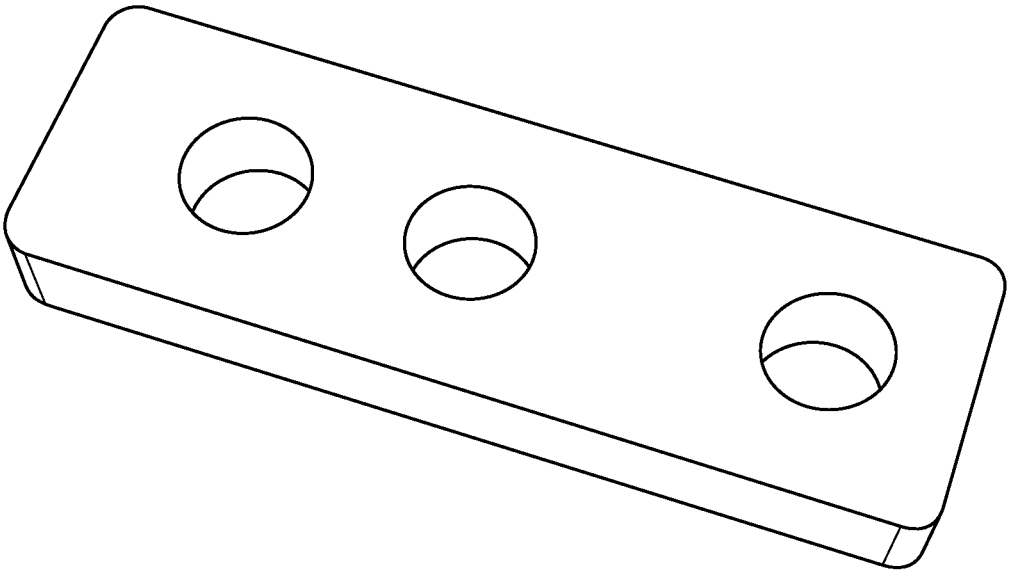

FIG. 4A shows the gas block riser. This part increases the height of the gas block so that it can be more aligned to the gas tube. Due to the size of the chamber and the increased size of the barrel and barrel nut, the height of the gas tube hole had to be increased.

Figure 4B:
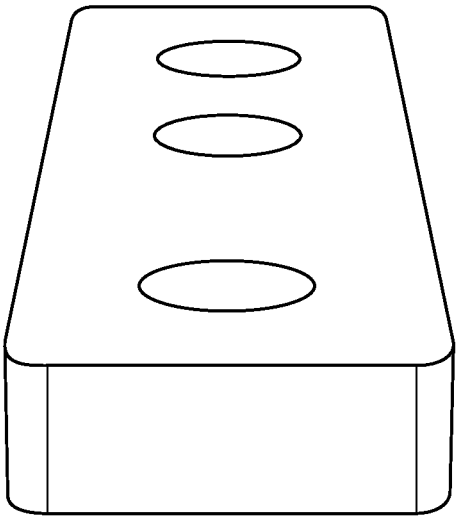

FIG. 4B is a view of the gas block riser

Figure 5A:
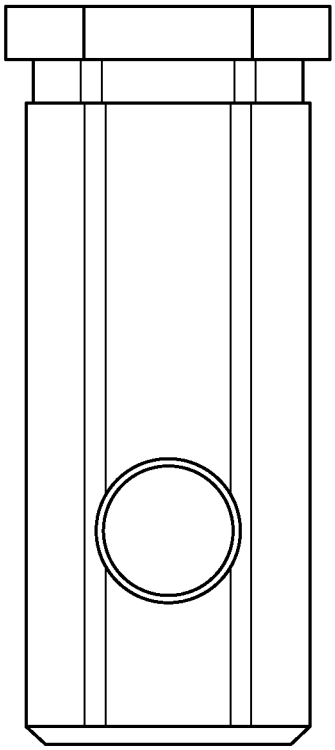

FIG. 5A shows the cam pin. The flange at the top is rounded with 2 flats running parallel to each other so that it can ride along the gas slot of the upper receiver. The flange also prevents the pin from dropping too far into the bolt and bolt carrier. The cross hole in the cam pin is there to allow the firing pin to pass through which keeps the cam pin from rotating and also acts as an arbor for the firing pin. The cam pin for the Direwolf is extended to compensate for the increased size of the bolt carrier.

Figure 5B:
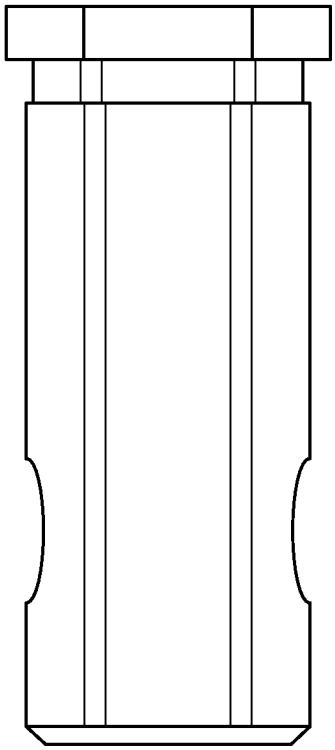

FIG. 5B is a view of the cam pin.

Figure 5C:
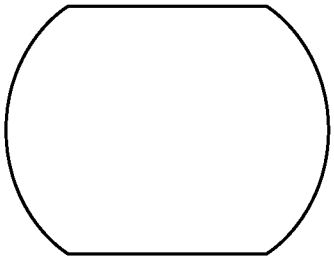

FIG. 5C is a view of the cam pin.

Figure 6A:
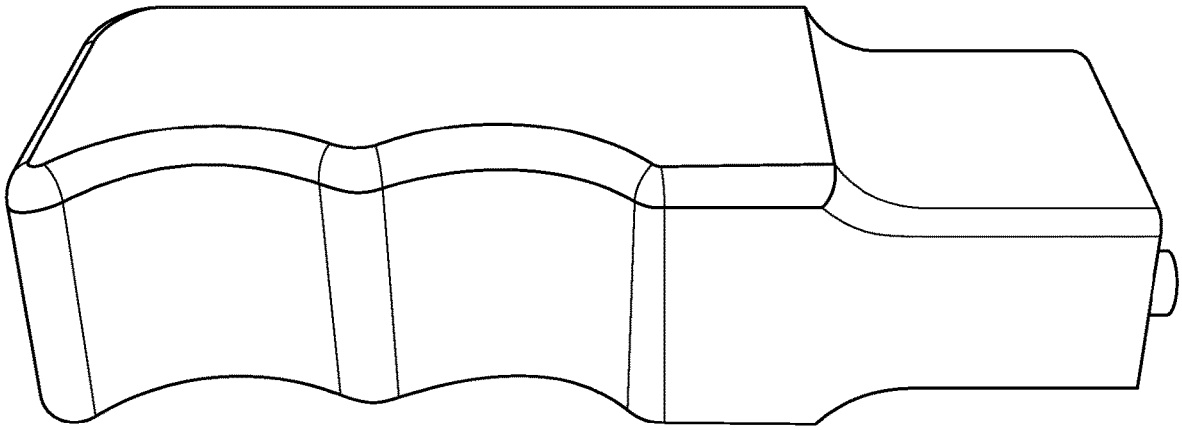

FIG. 6A shows the charging handle, it is a rectangular piece of aluminum with 2 scallops for ease of use and allows fingers to sit comfortably and grip the handle securely. There is a hole that runs length wise throw the handle and is used to run a bolt that threads into the bolt carrier.

Figure 6B:
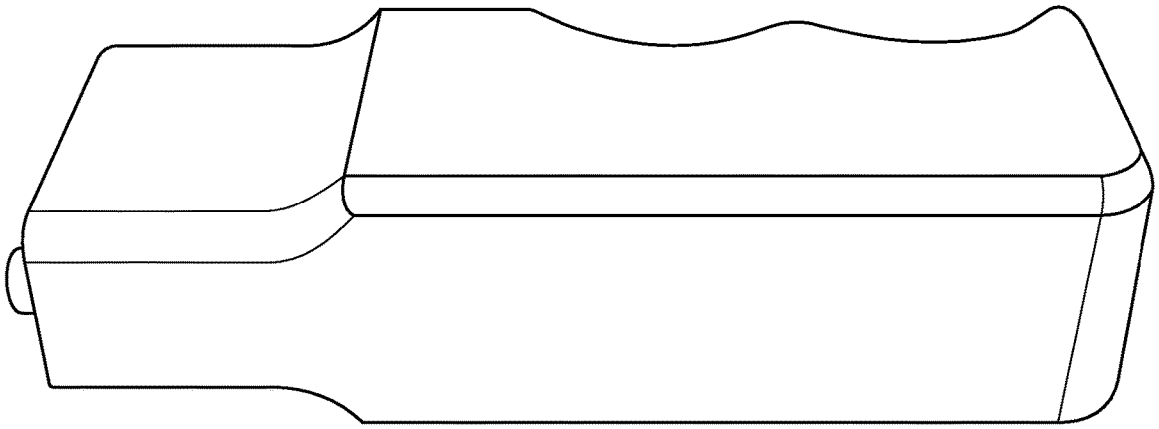

FIG. 6B is a view of the charging handle.

Figure 6C:
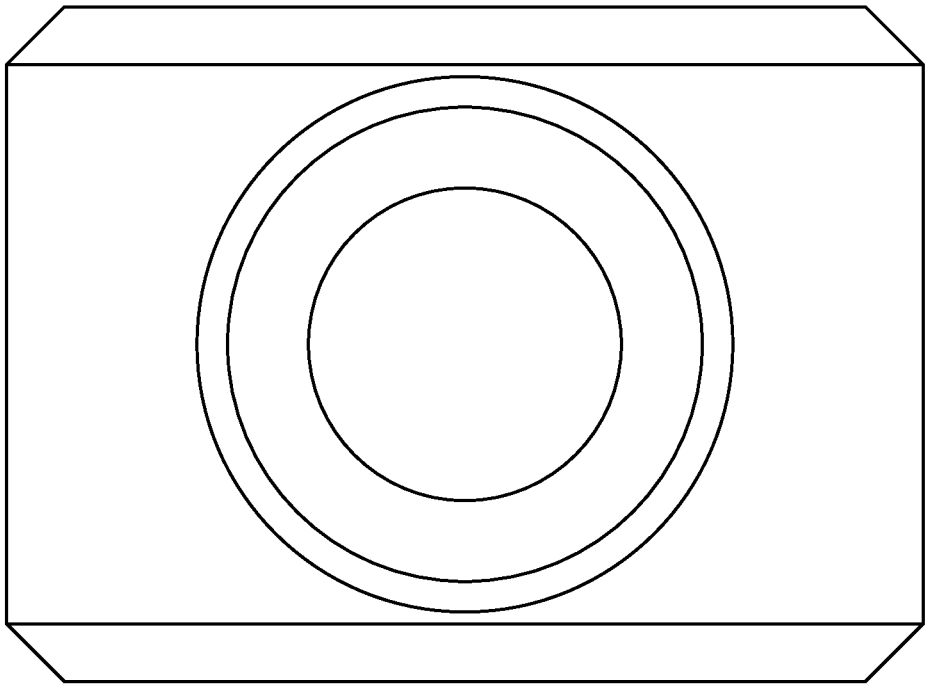

FIG. 6C shows the counter bore to allow the bolt head to sit flush when mounted on the bolt carrier.

Figure 6D:
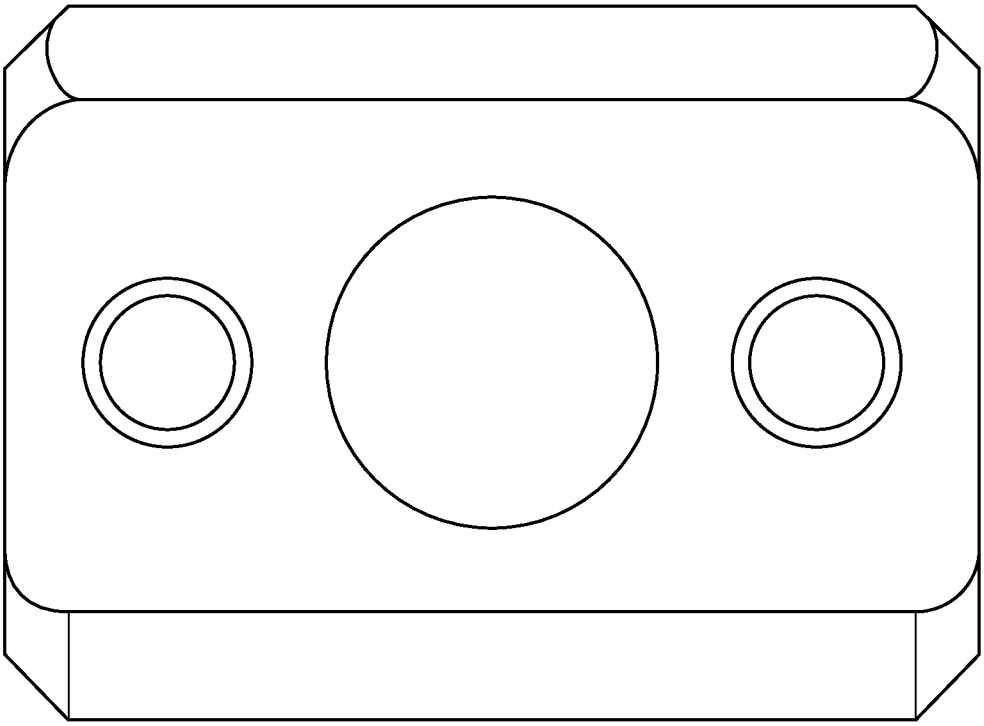
Figure 6E:
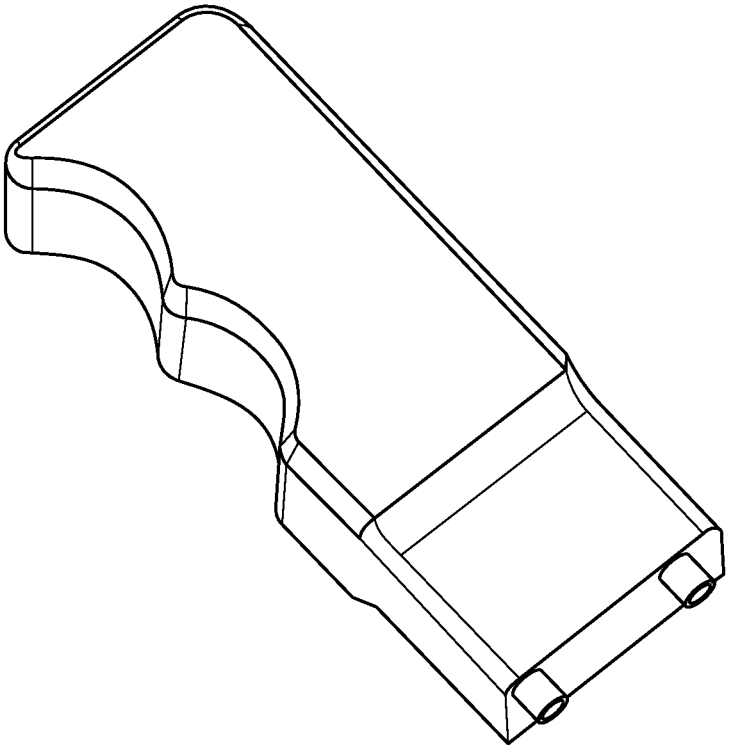

FIG. 6D shows the 2 pins on both sides of the mounting hole that insert into 2 holes and align the charging handle while at the same time adding shear strength to it.

Figure 7:
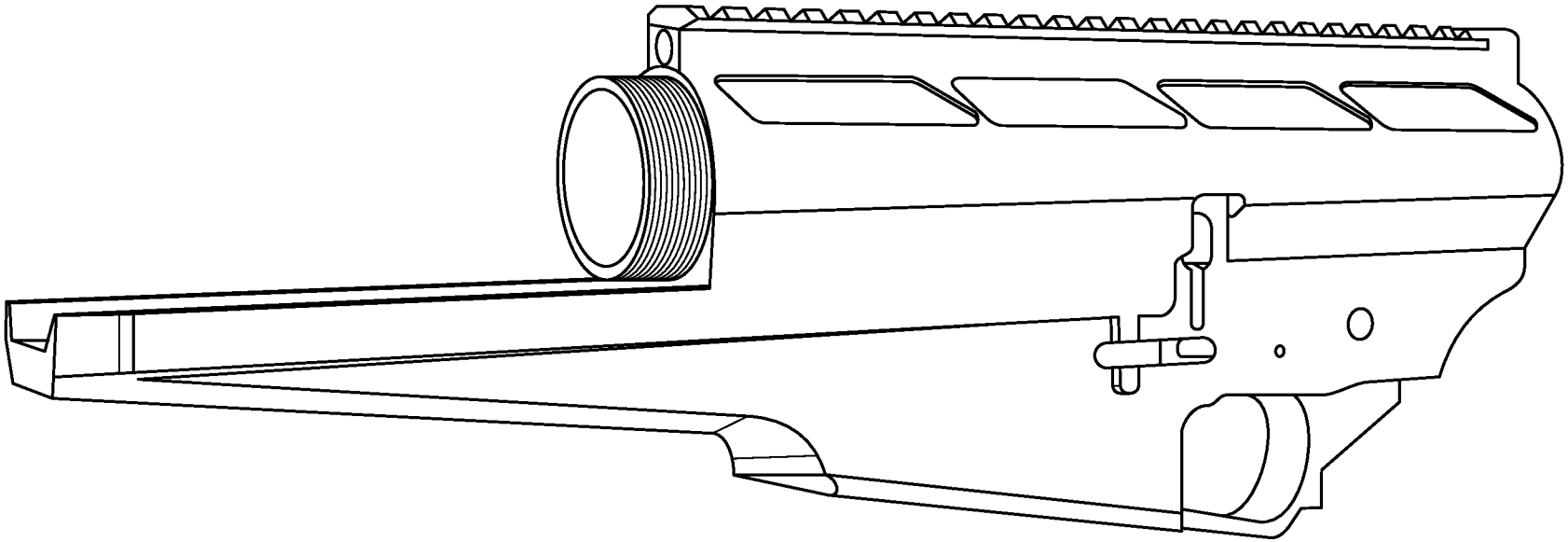

FIG. 7 shows that unlike conventional AR platform rifles, the upper and lower receiver of the semi-automatic rifle are mated together using locating bosses with bolts through the center. This allows for a more accurate and rigid receiver set increasing durability and accuracy. There is an additional boss on the upper receiver at the rear for attachment of the buffer tube adapter. The receiver was designed to be a gas/bolt gun hybrid utilizing the benefits of a bolt gun and without the drawbacks of a traditional gas gun. Upper receiver is highlighted in red, lower in blue, and threaded inserts and mounting screws are highlighted in gold below.

Figure 7A:
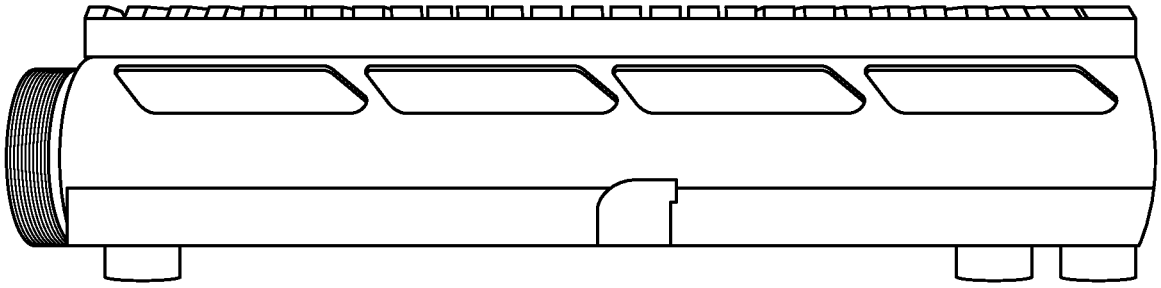

FIG. 7A shows side profile of upper receiver, detailing on the side is for weight reduction and clearance of bolt catch from the lower receiver. Name of rifle is engraved on this side as well. From this angle you can see the threaded front portion of the receiver which is where the barrel extension is inserted and a barrel nut is torqued over to keep barrel in place. On the bottom you can see both of the round bosses that attach the upper receiver to the lower. As well as the rear boss for the attachment of the buffer adapter. This side profile also shows the detail of the integral picatinny rail on the top.

Figure 7B:
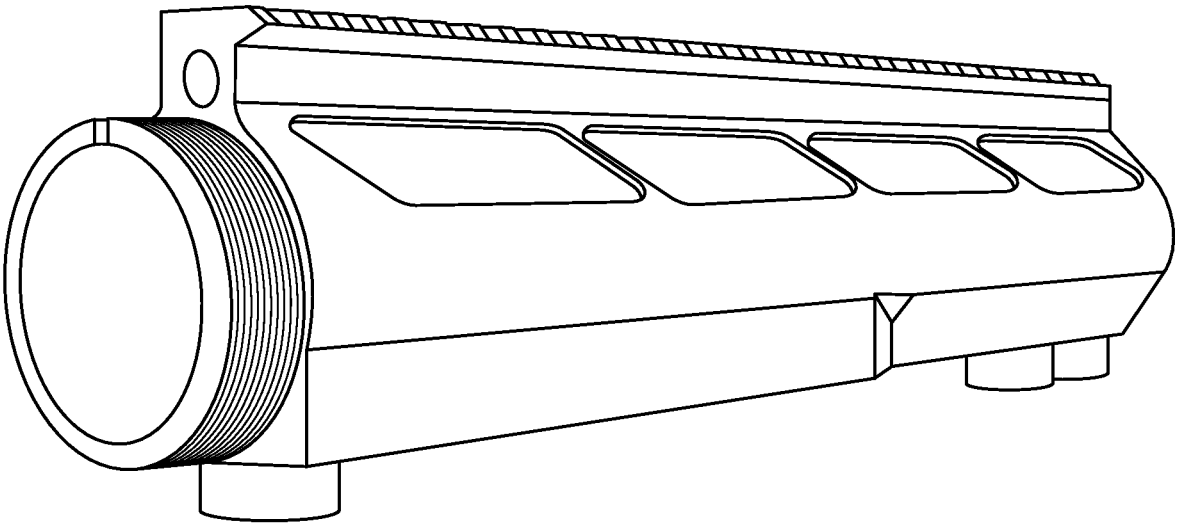

FIG. 7B shows an angled view of the same side above, this provides a better view of the barrel extension interface and barrel nut interface. Threaded portion in the front is keyed for aligning the barrel extension. Also, above the barrel interface is a threaded hole, this holds a threaded insert that retains a Delrin insert that prevents metal on metal contact of the gas tube and supports the tube.

Figure 7C:
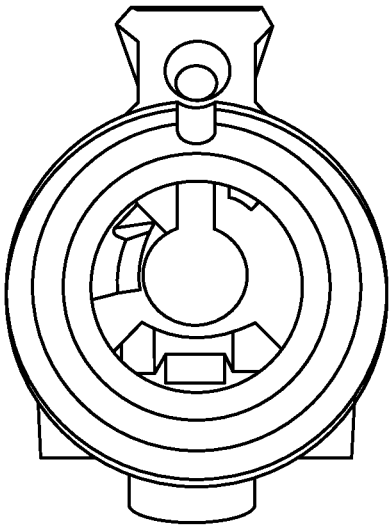

FIG. 7C shows the receiver from the front, the bore of the barrel extension is tapered at 45 degrees on the bottom, the barrel extension is tapered on the front and back to provide a barrel interface that is fully supported and aligned straight and solid. Through this you can also see the bore for the bolt carrier group. Above is a better view of the bore for the threaded insert and Delrin insert for gas tube support.

Figure 7D:
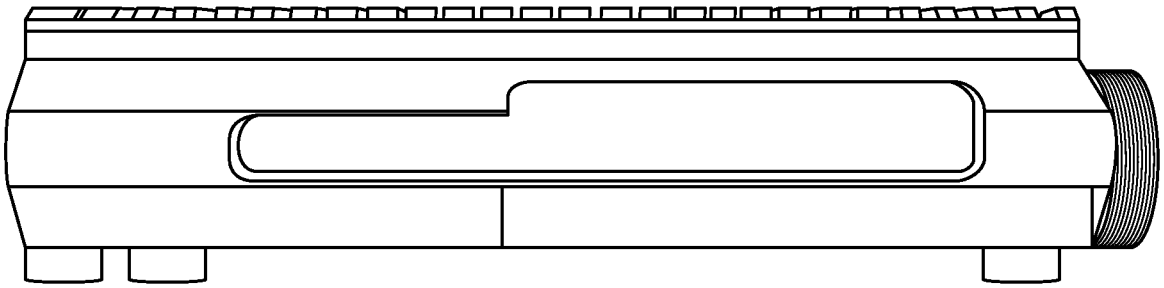

FIG. 7D shows the opposite side of the upper receiver, this side shows the ejection port and slot for the bolt handle to travel in. You can also see the same items that were outlined on the other side of the upper receiver, I will detail further in the descriptions for views that show the items better.

Figure 7E:
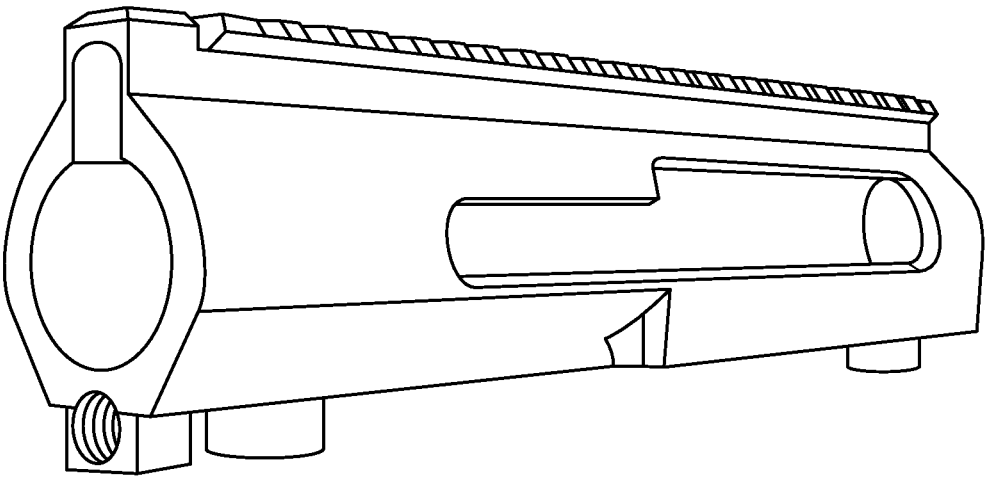

FIG. 7E shows an angled view of the ejection port side and the back of the receiver. On the rear of the receiver the bore for the bolt carrier continues through the length of the receiver with the addition of the slot on the top which allows the gas key attached the carrier to enter the upper. On the bottom of the rear is a threaded hole for a threaded insert to attach the buffer adapter to the upper.

Figure 7F:
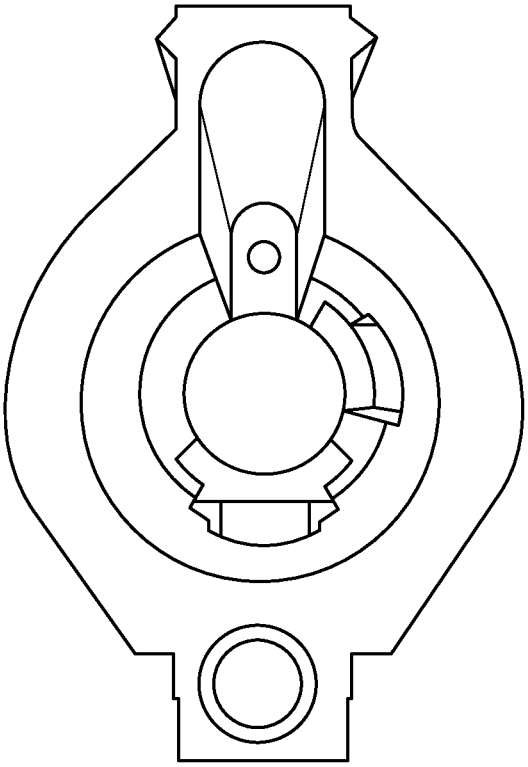

FIG. 7F shows the back of the upper receiver. You can see the full channel for the gas key and the full length bore. Also, a better view of the threaded hole for the threaded insert to attach the buffer adapter.

Figure 7G:
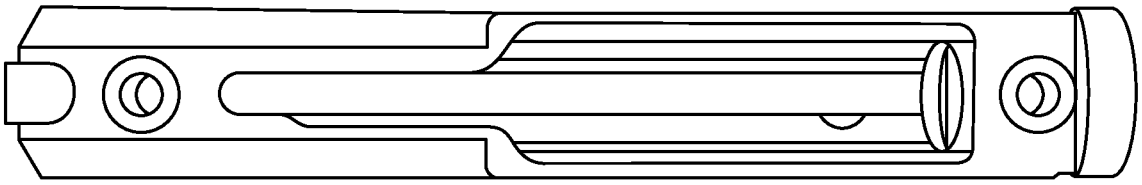

FIG. 7G shows the bottom of the upper receiver. Here you can see the detail of the bosses that have threaded holes for threaded inserts, this is the attachment point for the lower to upper interface. Also the rear boss is the same one from above that another threaded insert is placed in for attachment of the buffer adapter. On the bottom you can also see the cut out for the magazine and trigger group, these allow parts from the lower to interface with the upper.

Figure 7H:
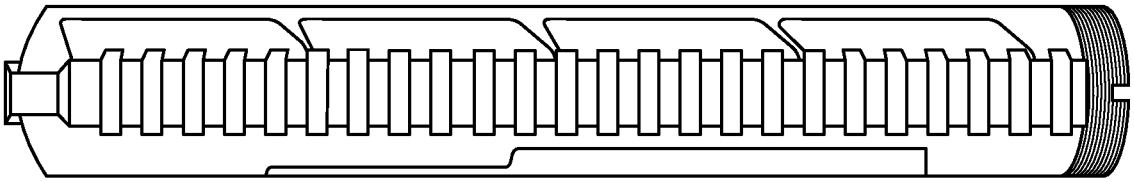

FIG. 7H shows the top of the upper receiver. This shows the full profile of the integral picatinny rail. As well you can see the profile of the weight reduction cuts and the ejection port. Another thing you can see better is the groove for the key on the barrel extension which is on the front of the receiver in the threaded portion.

Figure 7I:
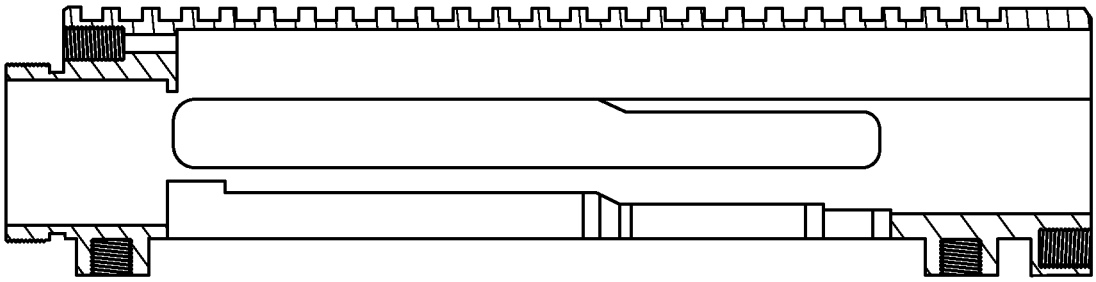

FIG. 7I shows a cut away of the upper receiver. With this image you can see all the threaded locations for inserts and the barrel nut. Also, it's easier to see how deep all of the holes and bores are. This just shows the ejection port side but the other side is very similar minus the ejection port.

Figure 7J:
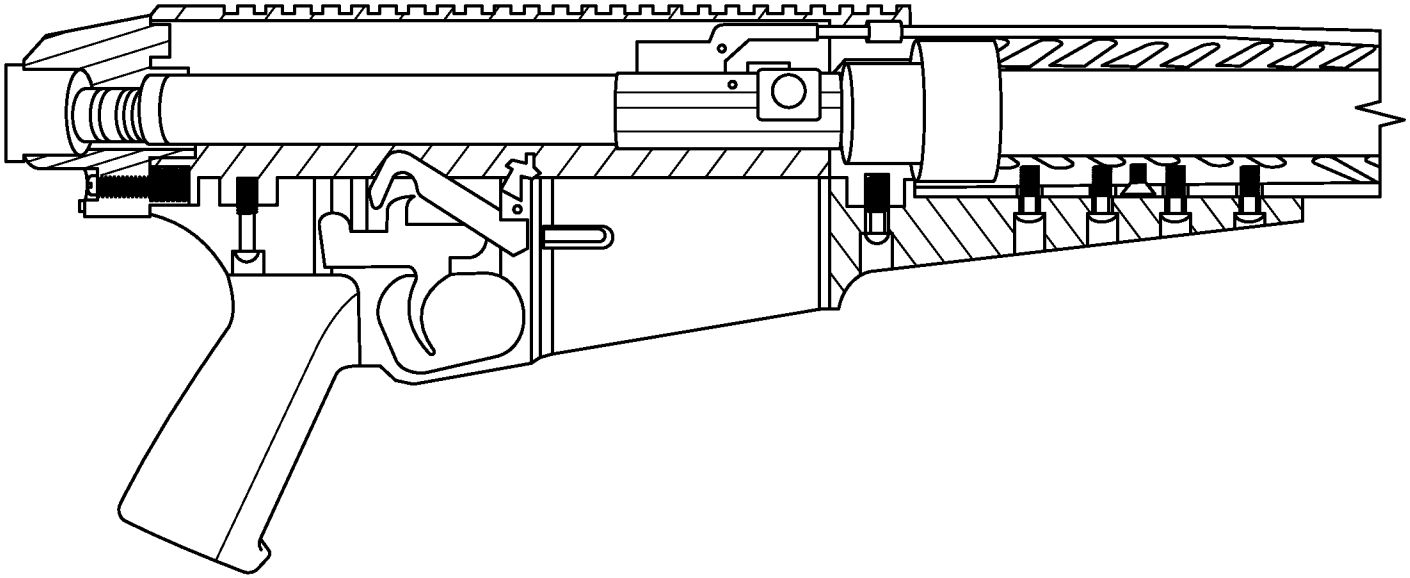

FIG. 7J is a view of the receiver set.

Figure 8A:
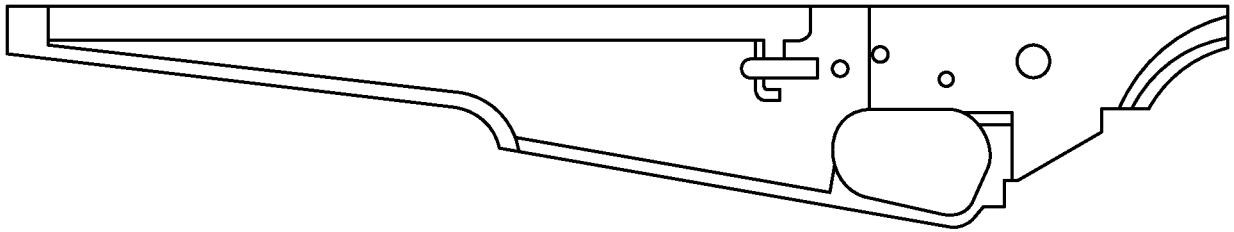

FIG. 8A depicts a side profile of the lower receiver. From this side you can see the pin holes for mounting an AR trigger assembly and bolt catch along with mag release. This lower accepts AR 15 style grips and has an extended shelf with mounting holes to attach the forend so that it is not putting any stress on the upper. The trigger guard is made larger to allow the use of firing with gloves.

Figure 8B:
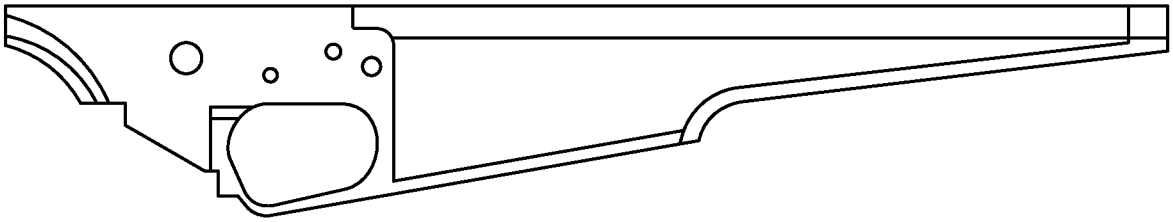

FIG. 8B is a side profile of the lower receiver.

Figure 8C:
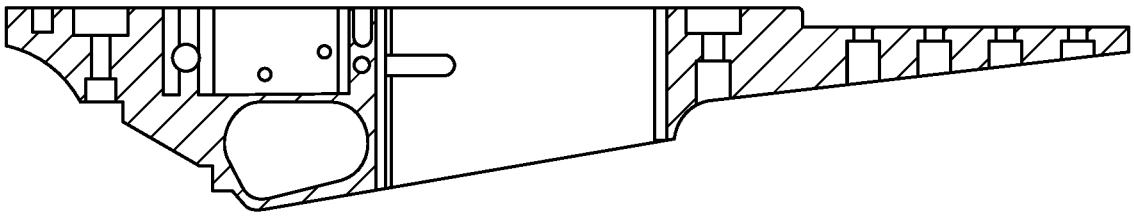

FIG. 8C shows a view of the lower cut in half. In this view you can see the internals of the trigger pocket, the mag well and the pockets for the boss's of the upper that mate with the lower. The upper is secured by 2 bolts that come from the lower and thread into metal inserts attached to the upper.

Figure 8D:
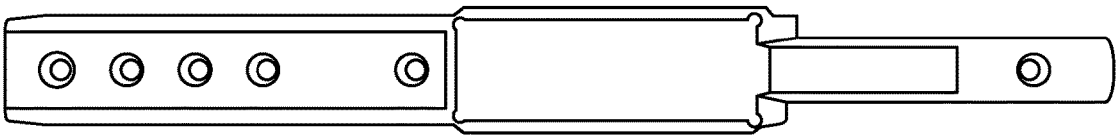

FIG. 8D shows a view from the bottom of the lower receiver depicting the counter bores for the upper mounting bolts and forend mount screws. Also visible is the mag well for our custom manufactured magazines.

Figure 8E:
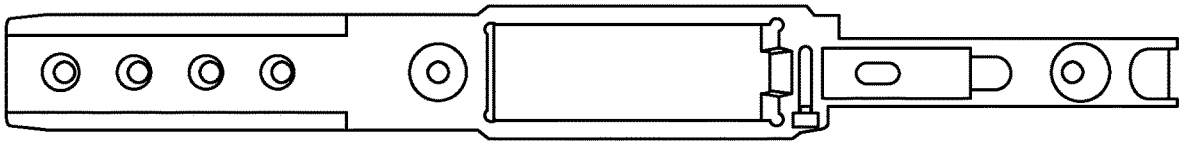

FIG. 8E shows a top view of the lower. There are the pockets for the locating boss's of the upper, the trigger pocket, the slot for the bolt catch and the cut out for the forend.

Figure 8F:
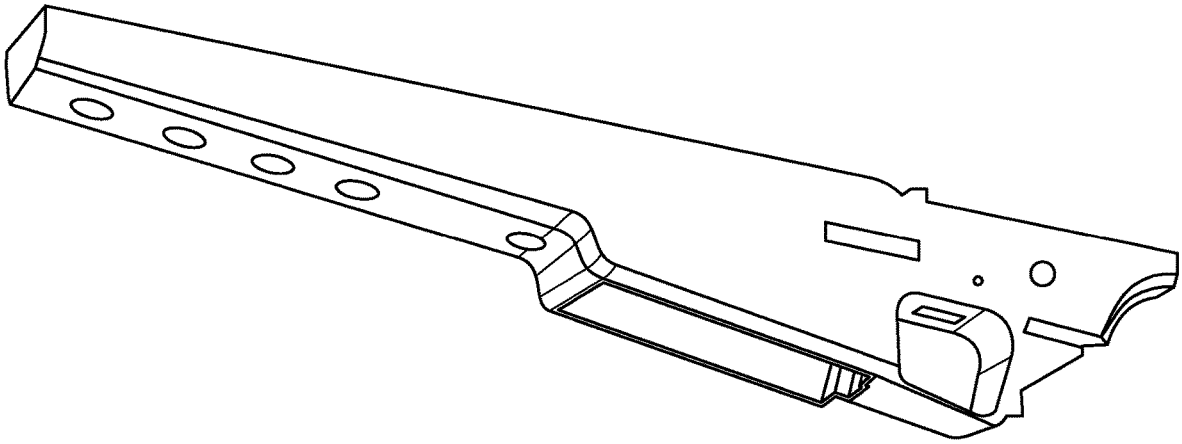

FIG. 8F is a view of the lower receiver.

Figure 9:
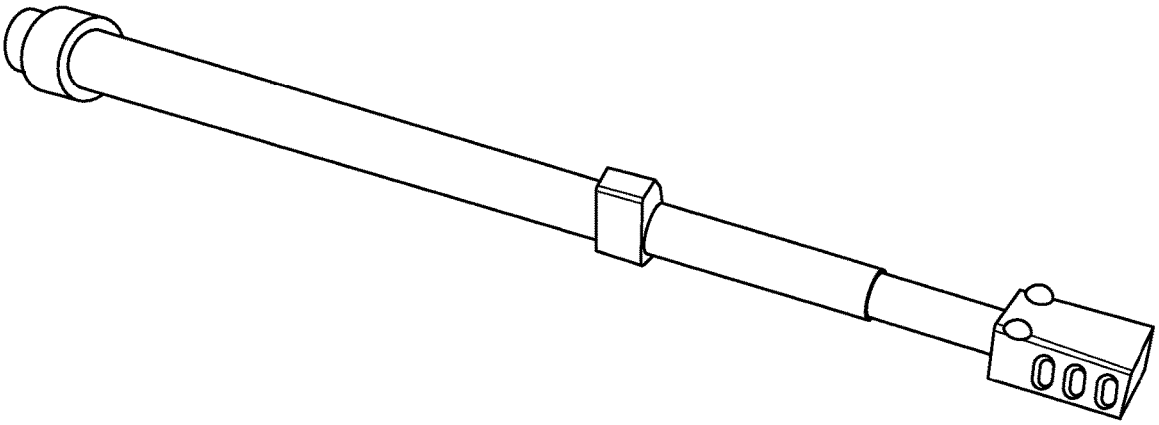

FIG. 9 shows the barrel assembly.

Figure 9A:
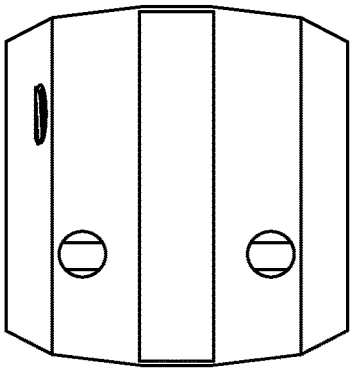

FIG. 9A shows a top view of the gas block. Depicted here is the cross hole that holds the pin that secures the gas tube and the adjustment screw for varying the amount of gas that is allowed to pass back through to the bolt carrier.

Figure 9B:
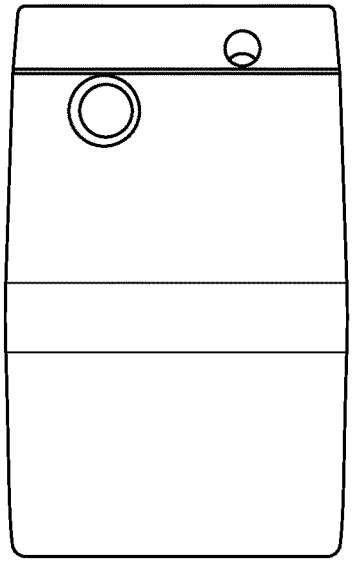

FIG. 9B Side view of the gas block showing the adjustment screw and gas tube cross hole.

Figure 9C:
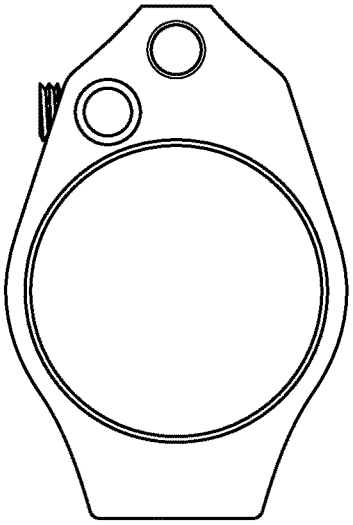

FIG. 9C is a view of the gas block.

Figure 9D:
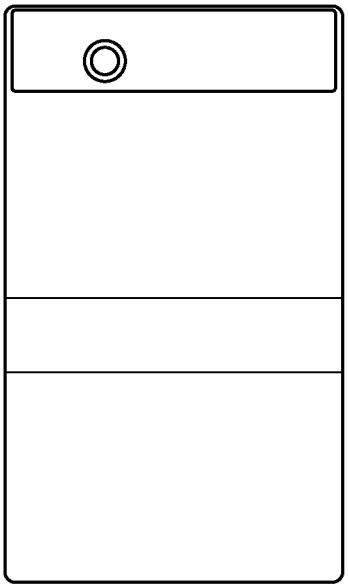

FIG. 9D is a view of the gas block.

Figure 9E:
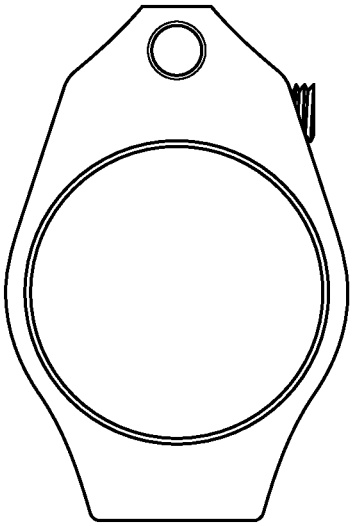

FIG. 9E is a view of the gas block.

Figure 9F:
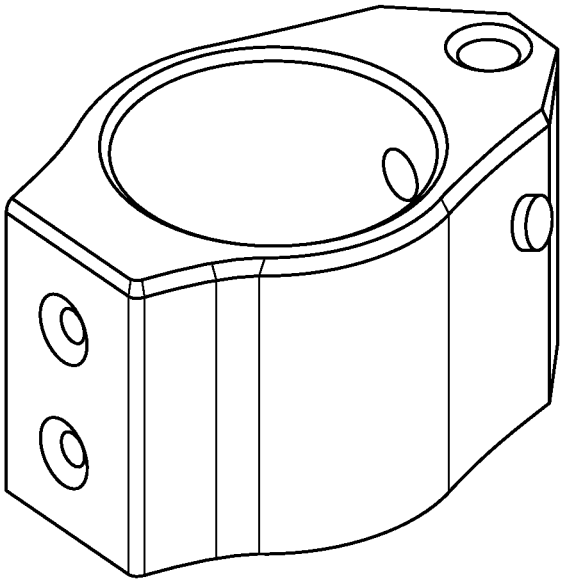

FIG. 9F shows an angled view of the gas block. Seen here is the bore of the gas block that fits tightly around the barrel. The two mounting screw holes that match two dimples on the barrel for perfect alignment of the gas ports. The gas port on the inside of the bore.

Figure 9G:
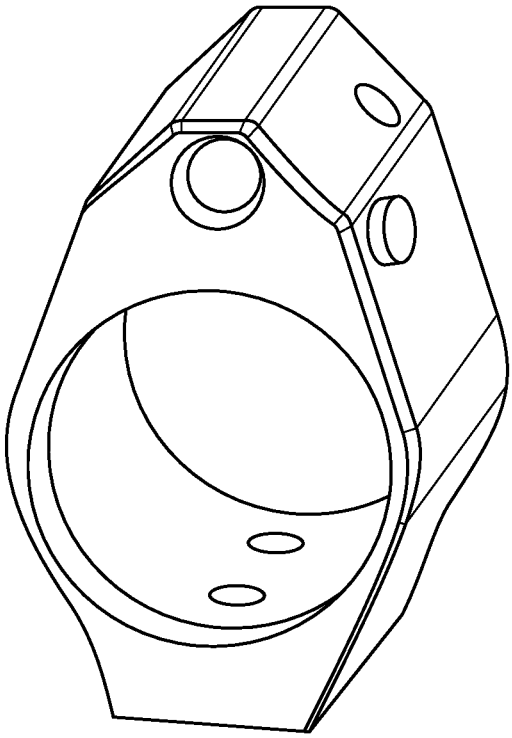

FIG. 9G is a view of the gas block.

Figure 10:
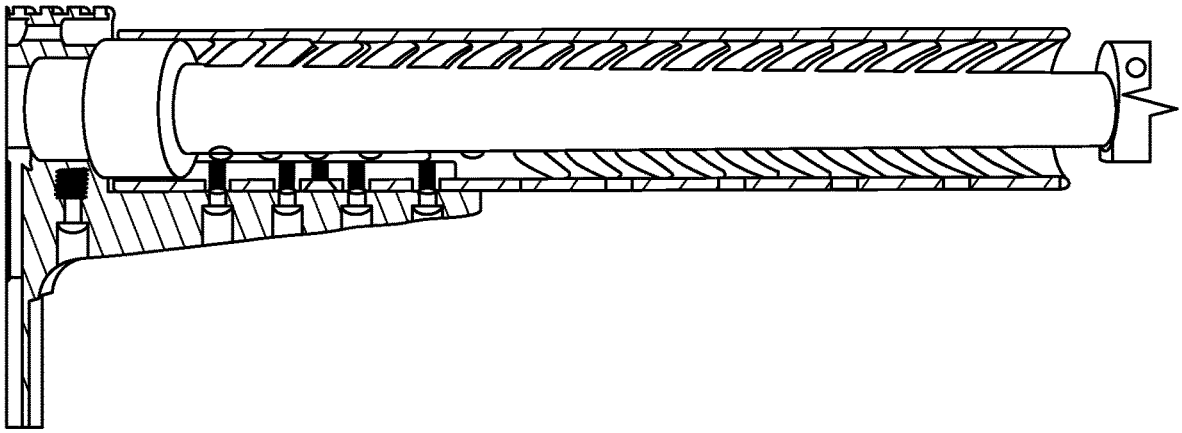

FIG. 10 shows the hand guard (FIG. 10) is free floating and attaches to the lower receiver eliminating stresses on the barrel and the action. It utilizes a one-piece steel strap (FIG. 11A) affixed to the hand guard with one bolt, keeping parts together during disassembly, the strap and hand guard assembly are then mounted to the lower receiver with 4 bolts. This eliminates stresses on the upper receiver which results in less harmonic distortion on the barrel increasing accuracy potential significantly. The slots machined into the hand guard allow for the use of M-LOK accessories and clearances have been put in place to allow for the gas tube to raise into the upper without friction. Handguard highlighted in red below to illustrate free floating and mounting plate highlighted in gold.

Figure 10A:
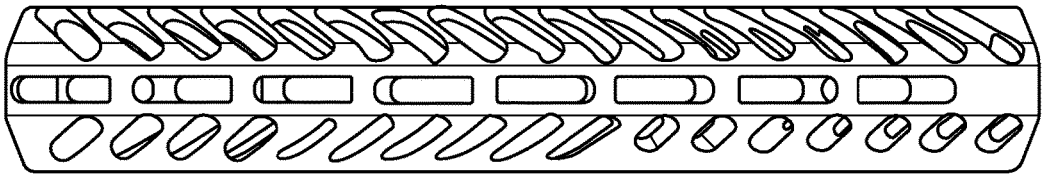

FIG. 10A shows a side profile of the hand guard. On four sides there are full length M-lok slots and in between are slots cut out for lightening.

Figure 10B:
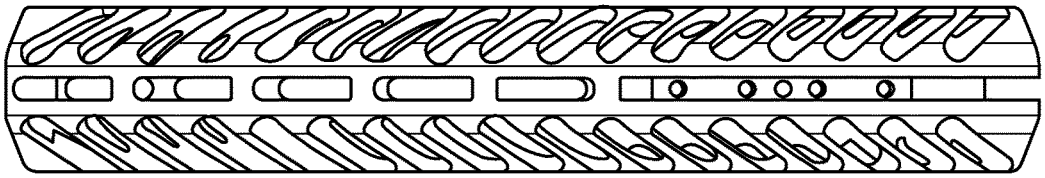

FIG. 10B shows a top view depicting the slot on the top that is needed so that the gas tube can pass through and continue into the upper receiver.

Figure 10C:
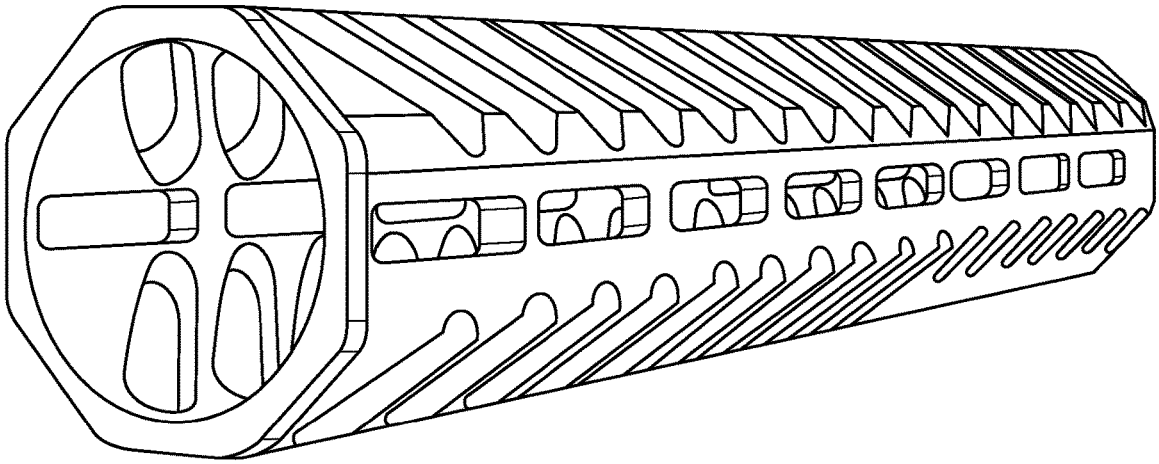

FIG. 10C is a view of the hand guard.

Figure 10D:
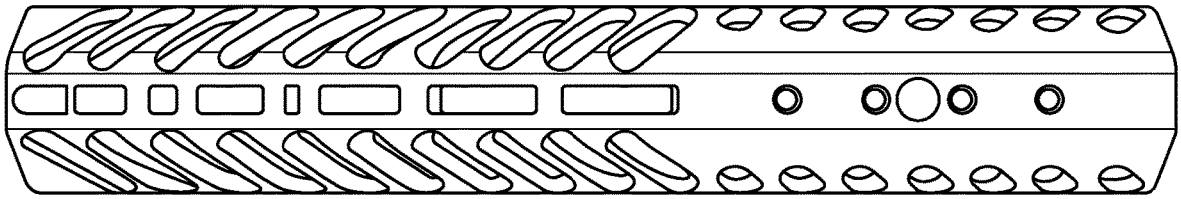

FIG. 10D shows a bottom view depicting the 45-degree angle cut so that the hand guard can seat nicely into the lower which is then bolted on with 4 mounting locations. A metal strap with threads is insert on the inside and the screws from the receiver are threading into them sandwiching the hand guard in place.

Figure 10E:
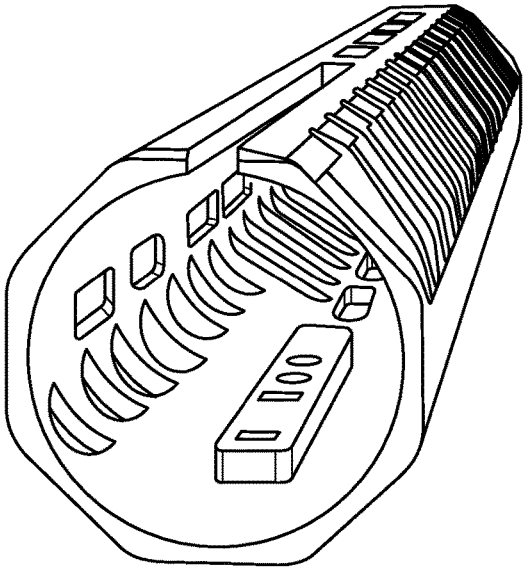

FIG. 10E is a view of the hand guard.

Figure 11A:
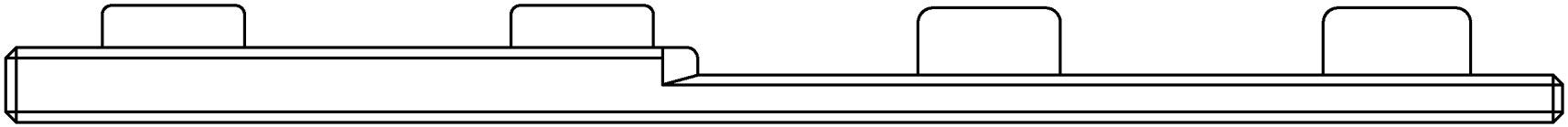

FIG. 11A shows the mounting strap for the hand guard, it has threaded holes with bosses surrounding them. The boss's act as locators and there is a smaller threaded hole so the strap can be mounted independently to the hand guard, once this is done the hand guard can be securely mounted to the lower.

Figure 11B:
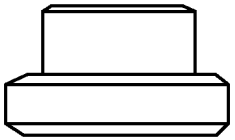

FIG. 11B is a view of the mounting strap.

Figure 11C:
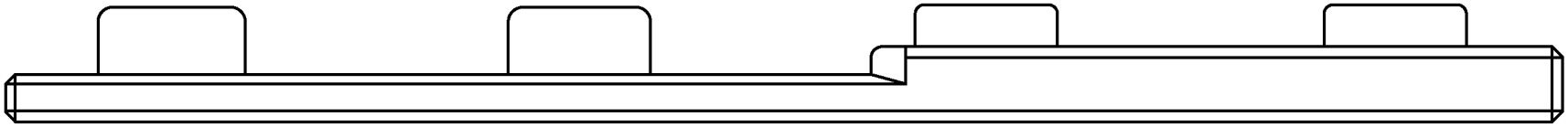

FIG. 11C is a view of the mounting strap.

Figure 11D:
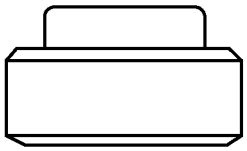

FIG. 11D is a view of the mounting strap.

Figure 11E:
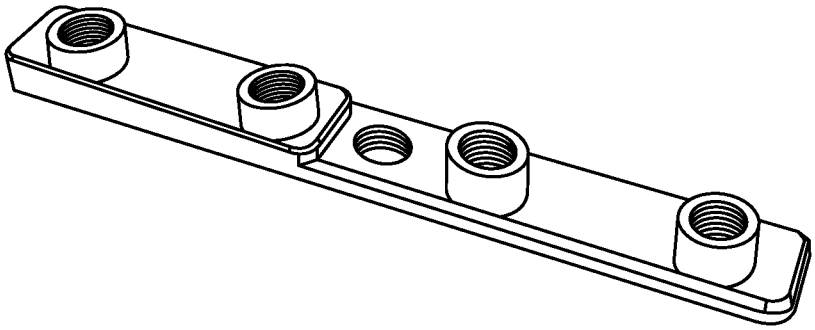

FIG. 11E is a view of the mounting strap.

Figure 11F:
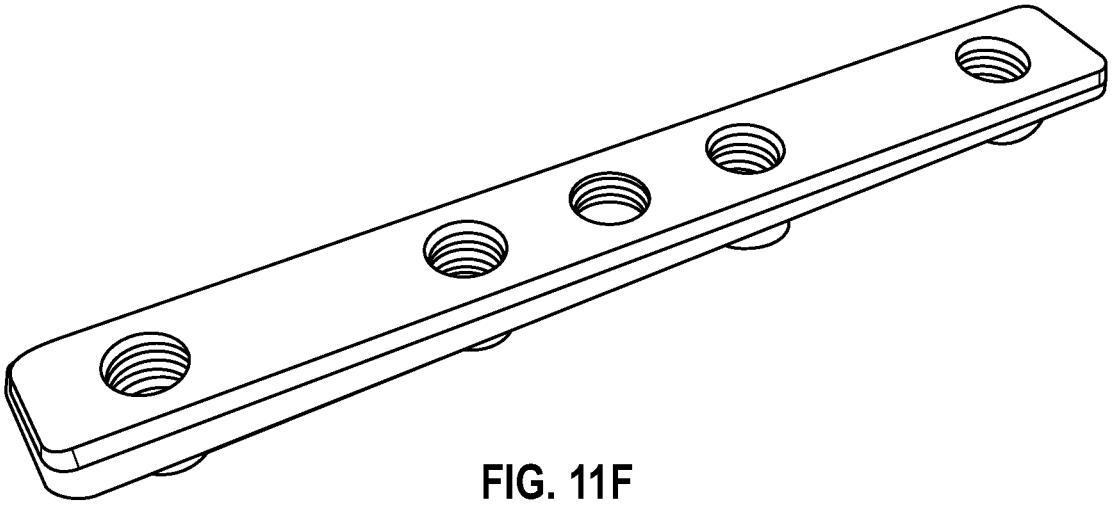

FIG. 11F is a view of the mounting strap.

Figure 12A:
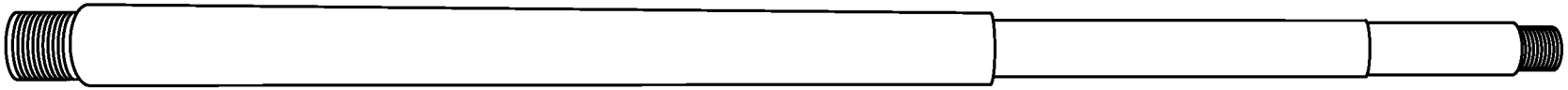

FIG. 12A shows the rifled barrel, with a machined diameter, gas hole and locating dimples to accommodate the gas block. The muzzle is threaded to accommodate compensators, flash hiders and suppressors. The rear of the barrel is threaded to accept the barrel extension.

Figure 12B:
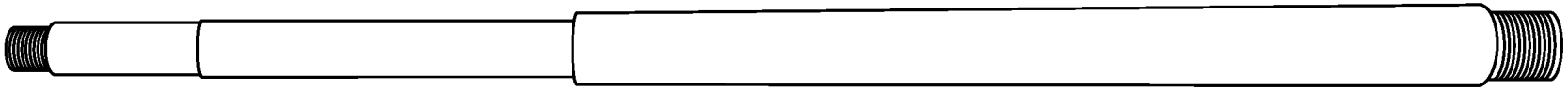

FIG. 12B is a view of the barrel.

Figure 12C:
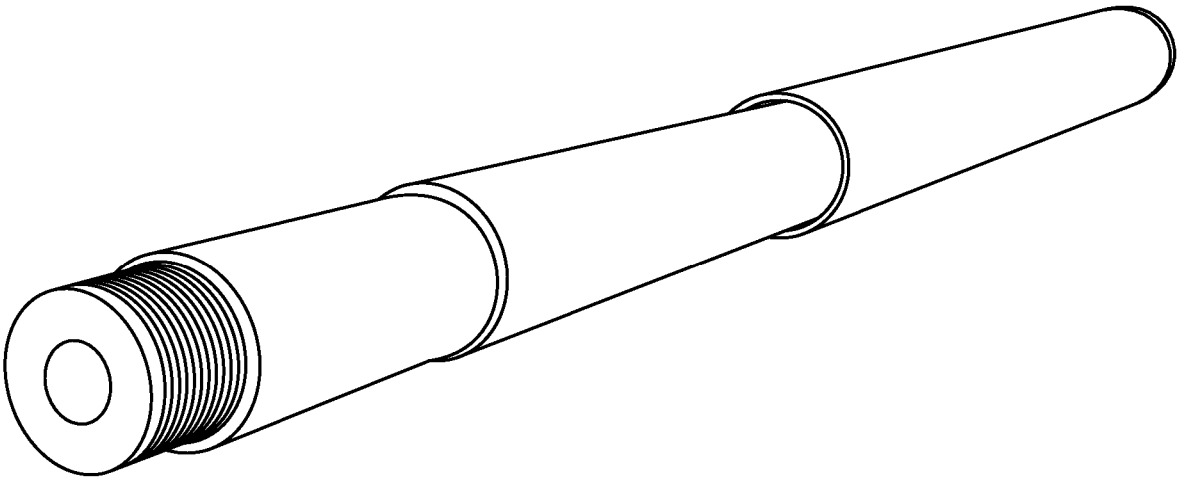

FIG. 12C shows the front view of the barrel exposing the muzzle and crown.

Figure 12D:
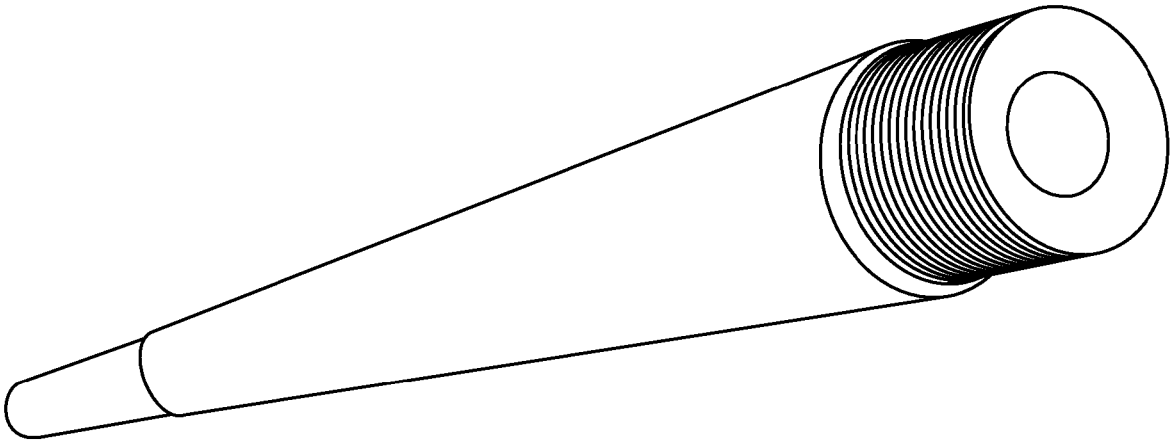

FIG. 12D shows the rear view of the barrel. Here you can see the chamber where the ammunition is seated.

Figure 13A:
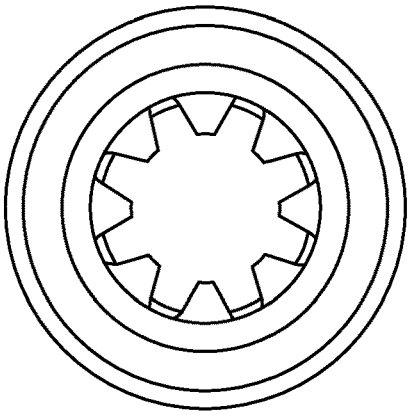

FIG. 13A Shows the front view of the barrel extension. Here you can see the pattern of the lugs that the bolt mates with.

Figure 13B:
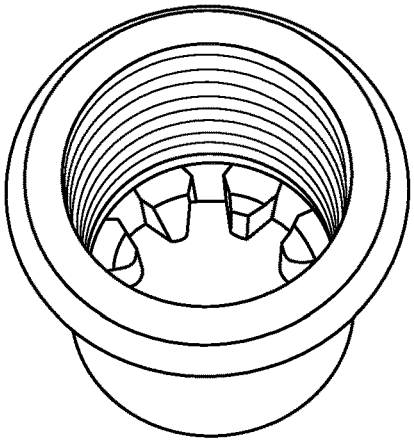

FIG. 13B shows the inside of the barrel extension where the ID is threaded so it can be fastened to the rear of the barrel and torqued on.

Figure 13C:
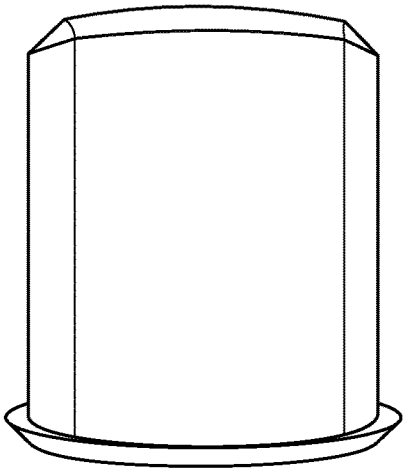

FIG. 13C shows the outside of the barrel extension that slides into the upper receiver, the tolerances are tight so that when the two are mated there is no play or wiggle in the barrel.

Figure 13D:
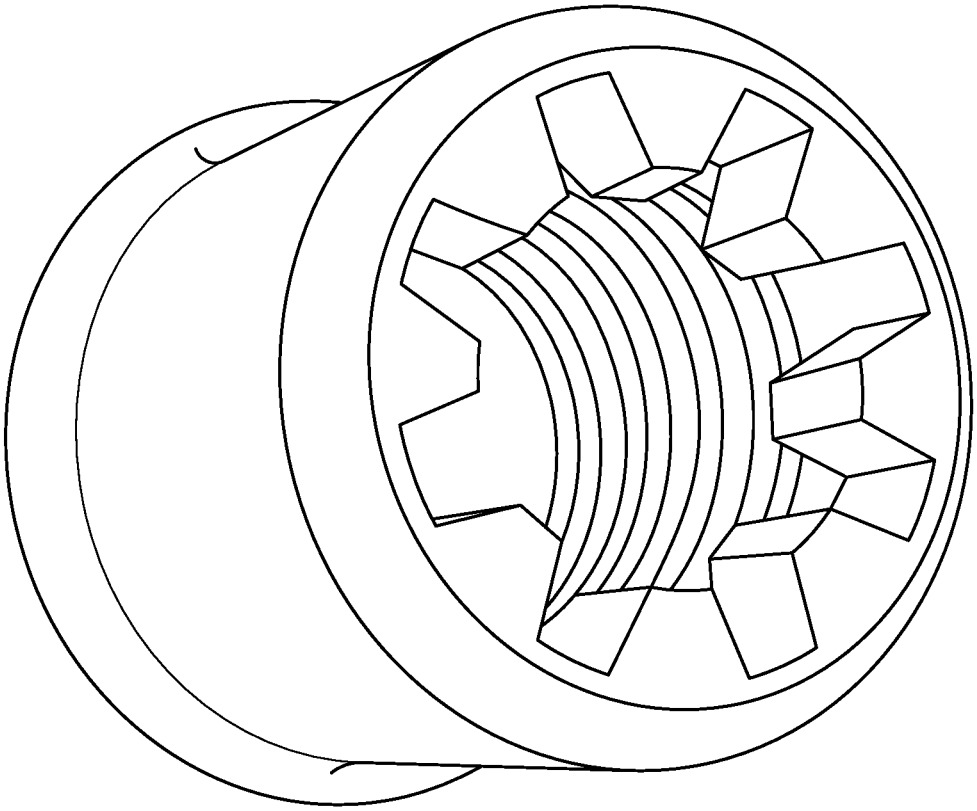

FIG. 13D is a view of the barrel extension.

Figure 14A:
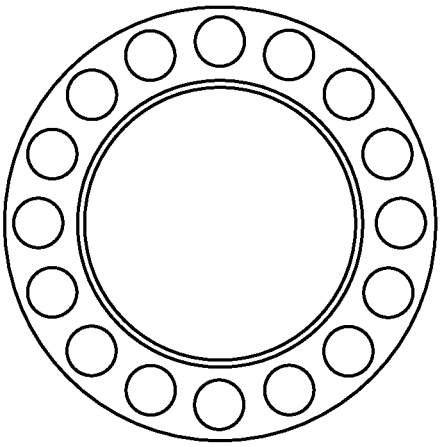

FIG. 14A shows the face of the barrel nut, the inside diameter is made with clearance so it can slip over the barrel. The pockets visible here are to accommodate a spanner and torque wrench.

Figure 14B:
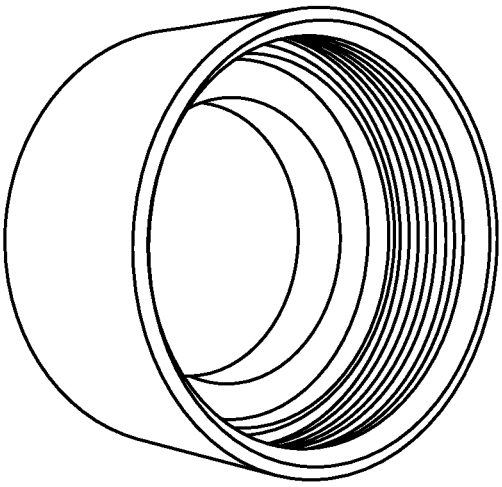

FIG. 14B shows the back side of the barrel nut which is threaded and fastened to the upper receiver.

Figure 14C:
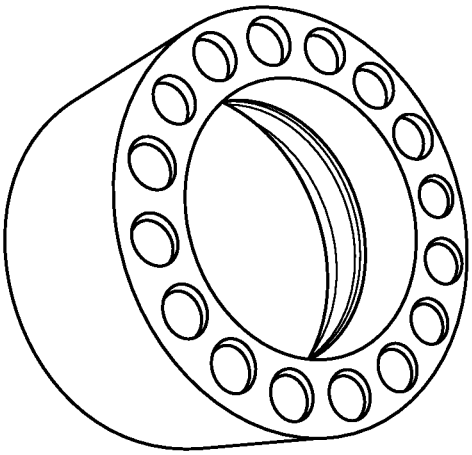

FIG. 14C is a view of the barrel nut.

Figure 14D:
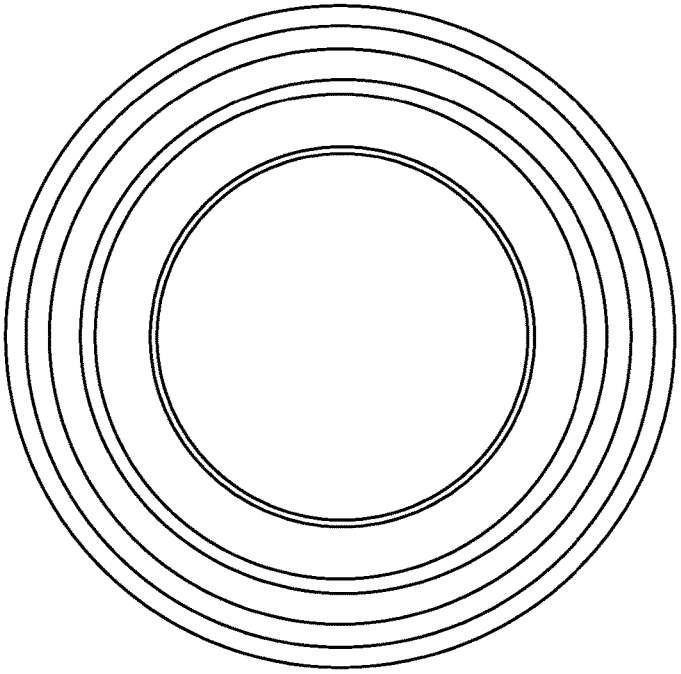

FIG. 14D is a view of the barrel nut.

Figure 15:
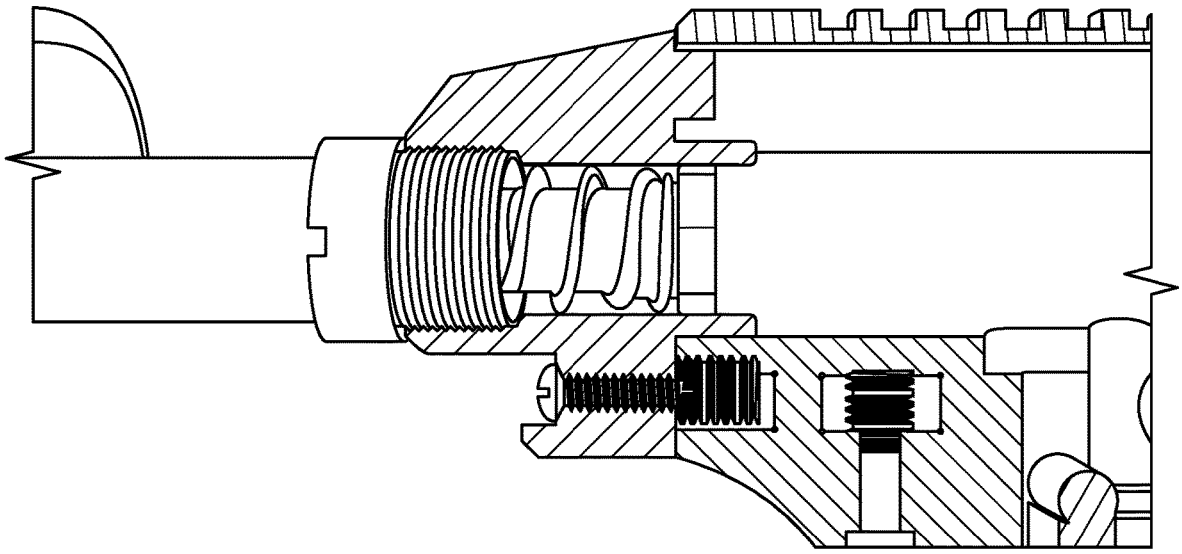

FIG. 15 shows the backside of the bolt carrier is supported by a bushing that is built into the buffer tube adapter. The bolt carrier in any position is always supported and makes for a smoother and more accurate operating rifle. The buffer tube adapter is held on by a single bolt and allows the access and removal of the bolt carrier group easily and without effort. This also allows access to clean the barrel from the rear of the action. The buffer tube adapter is highlighted in red and the mounting screw is highlighted in gold.

Figure 15A:
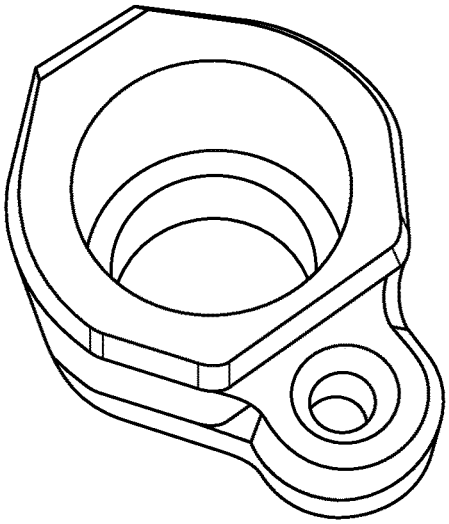

FIG. 15A shows the backside of the buffer tube adapter. The large thread accepts the buffer tube to fasten securely to the adapter. The smaller hole with the counter bore is to bolt the adapter to the receiver.

Figure 15B:
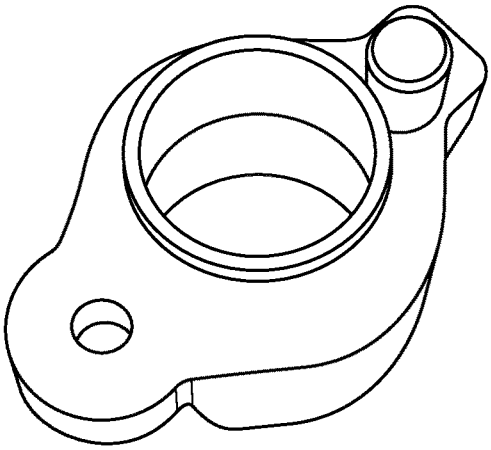

FIG. 15B shows the front of the buffer tube adapter. The adapter is located by the large boss on the back that fits into the large bore of the upper receiver. The smaller boss at the top is used to time it correctly by fitting in the gas tube slot in the upper receiver. Inside the boss is a bore that supports the bolt carrier and allows it to slide into the buffer tube freely and smoothly.

Figure 15C:
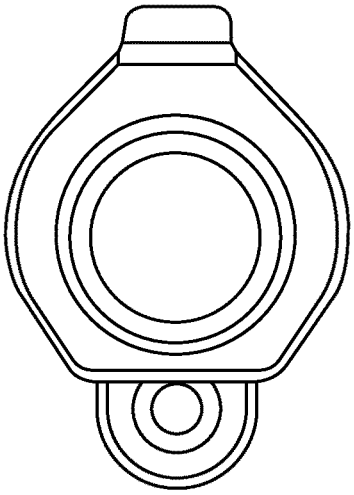

FIG. 15C is a view of the buffer tube adapter.

Figure 15D:
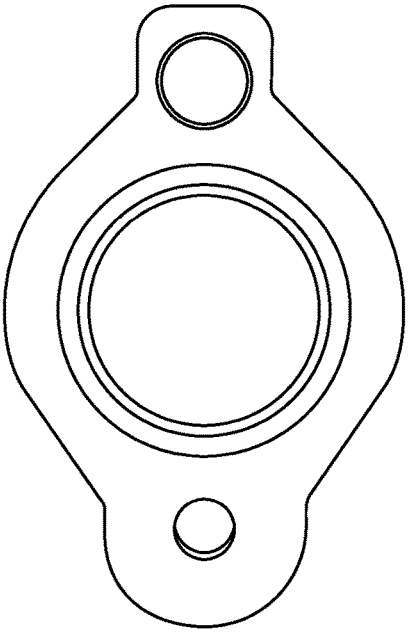

FIG. 15D is a view of the buffer tube adapter.

Figure 15E:
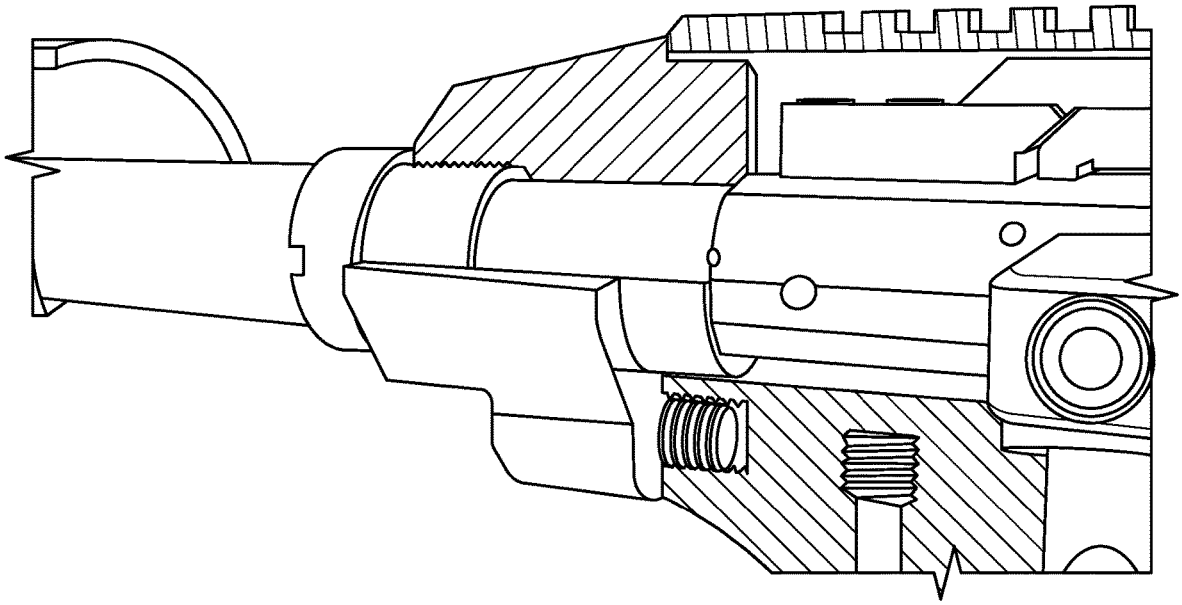

FIG. 15E shows ¾ of the buffer adapter is in place and the bolt carrier in the rear position to show how the carrier is supported. The boss protrudes into the upper receiver and wraps around the rear of the bolt carrier to fully support it.

Figure 16:
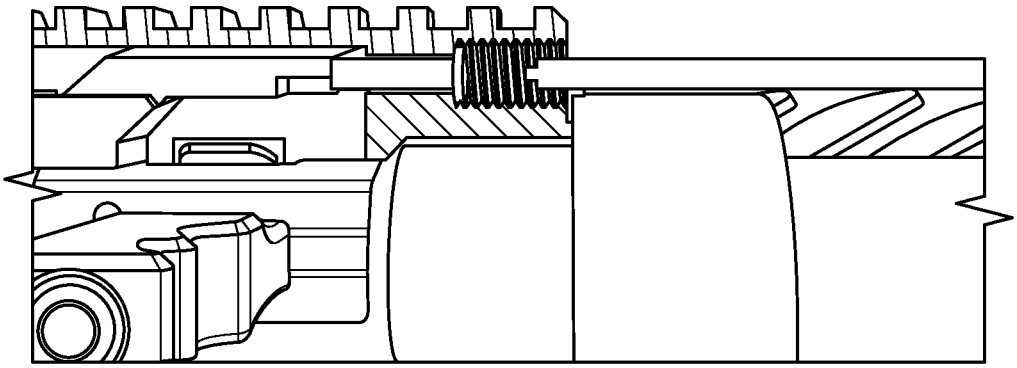

FIG. 16 shows the gas tube is positioned accurately in the upper receiver with an acetal composite bushing. This bushing is rigid and keeps the gas tube in place while also isolating the gas tube from the upper receiver, dampening harmonic vibrations. Due to the material it is made of it also reduces gas cutting and acts as a seal reducing forward facing gas expenditure. The bushing is held in place securely by a threaded insert with a hole through the center to allow the gas tube to pass through it (FIG. 16B). Bushing highlighted in red below to illustrate placement in receiver behind threaded insert which is also highlighted in gold.

Figure 16A:
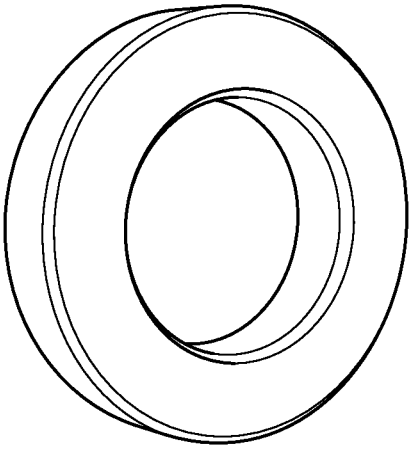
FIGS. 16A and 16B show the gas tube delrin bushing to isolate metal to metal contact and reduce the transmission of vibration.
Figure 16B:
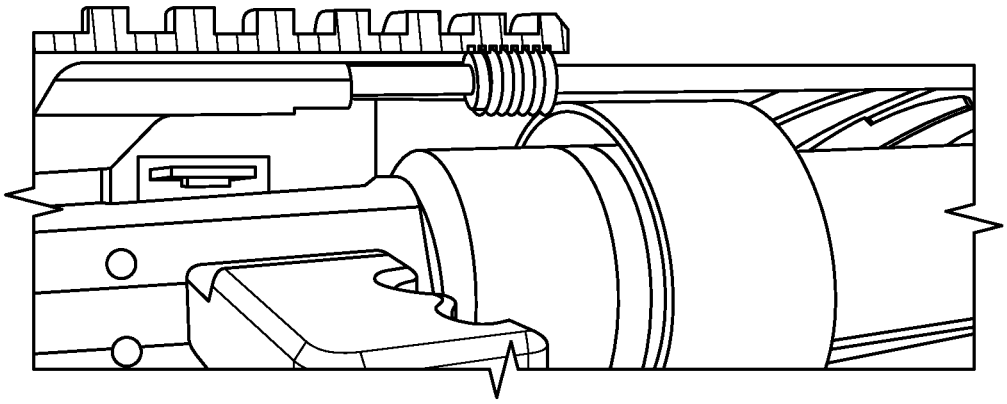

FIG. 16A shows the gas tube bushing. The large diameter fits tight into the bore of the gas tube inlet. The inside diameter is made to be a tight fit to the gas tube to ensure that the tube is positioned securely and accurately.

FIG. 16B shows the gas tube bushing in its correct position in the upper receiver, it is held in place by a threaded insert to prevent it from moving.

Figure 17A:
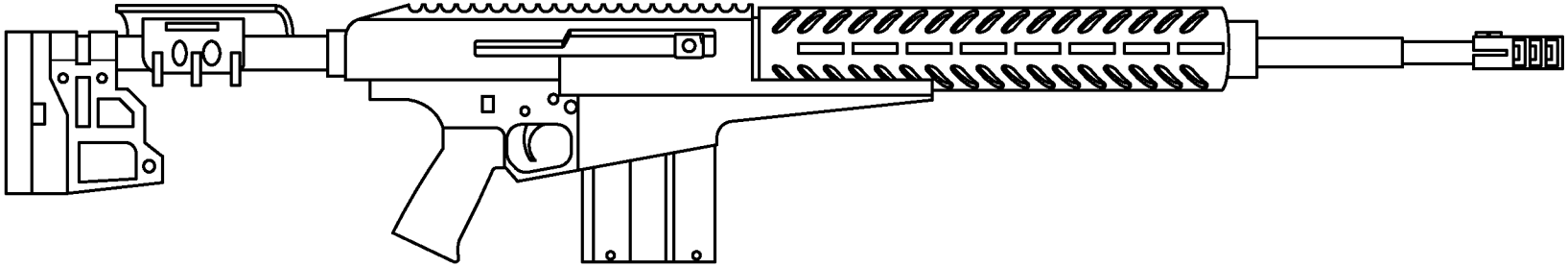
FIGS. 17A and 17B show the full assembly.

FIG. 17A shows the full assembly.

Figure 17B:
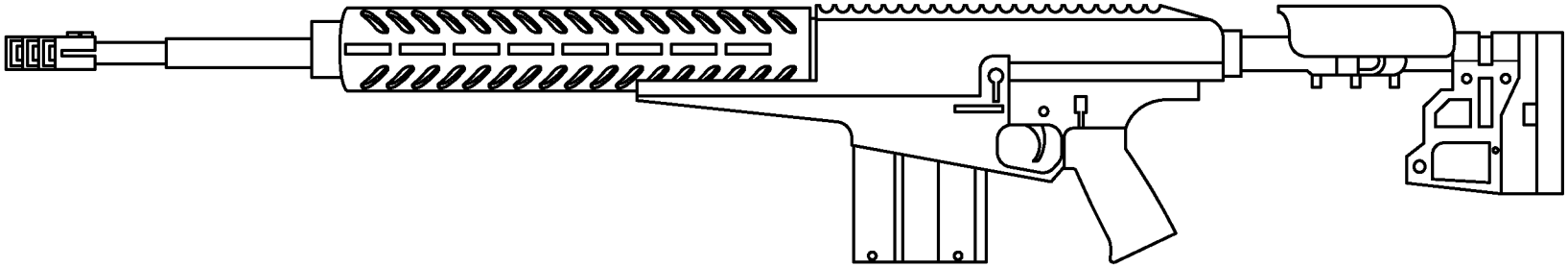

FIG. 17B shows the full assembly.

Figure 18A:
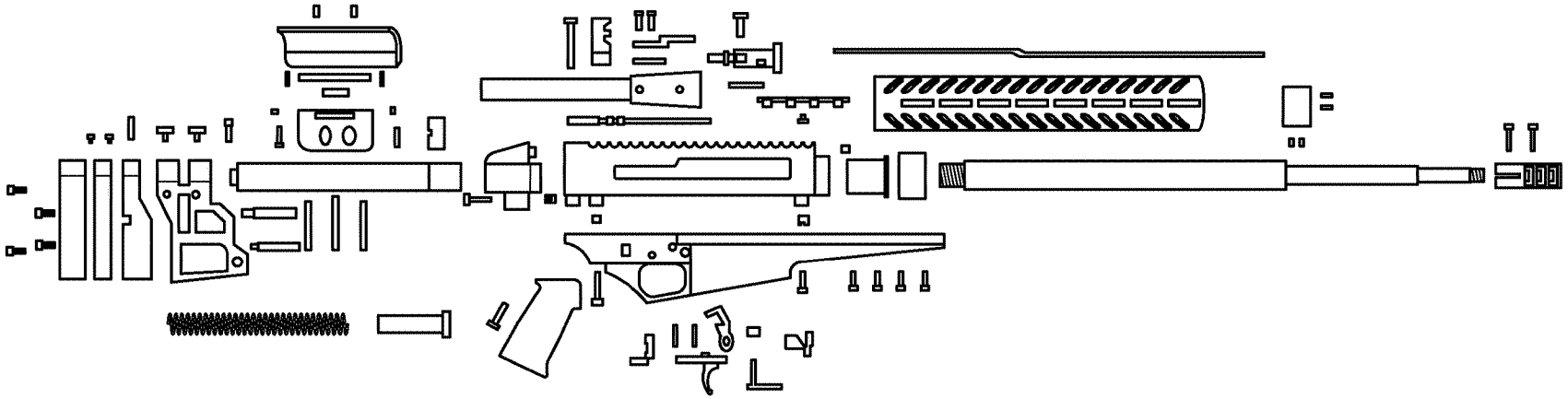
FIGS. 18A and 18B show the exploded views of the semi-automatic rifle.

FIG. 18A shows the exploded view.

Figure 18B:
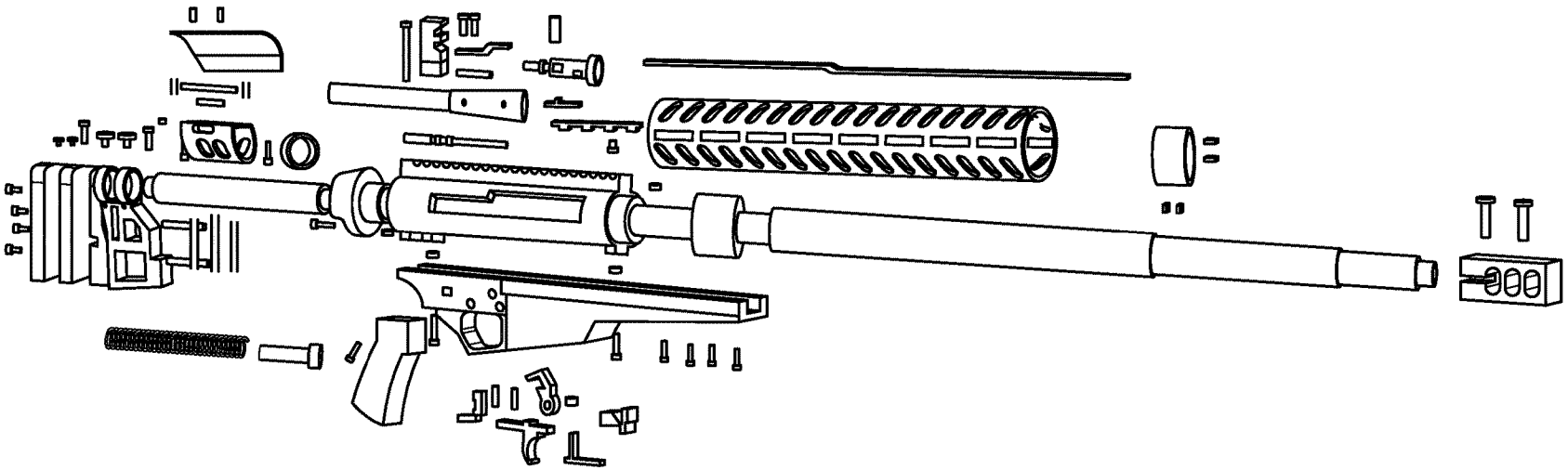

FIG. 18B shows the exploded view.

I claim:

1. A self-loading rifle comprising:

an upper receiver defining a bolt passage;

a bolt operable to reciprocate in the passage motivated by energy from discharge of the rifle;

a barrel extending from the upper receiver;

a lower receiver connected to the upper receiver and containing a trigger group;

the lower receiver having a forwardly-extending support below the barrel; and a tubular handguard encompassing at least a rear portion of the barrel, and connected to the forwardly-extending support.

2. The self-loading rifle of claim 1 in this the handguard is not directly connected to the upper receiver or to the barrel.

* * * * *